US006024168A

United States Patent [19]

Kuck et al.

[11] Patent Number: 6,024,168

[45] Date of Patent: Feb. 15, 2000

[54] WELLBORNE MILLS & METHODS

[75] Inventors: Mark D. Kuck; William A. Blizzard, Jr.; Thurman B. Carter, all of Houston; Guy L. McClung, III, Spring, all of Tex.

[73] Assignee: Weatherford/Lamb, Inc.

[21] Appl. No.: 08/962,162

[22] Filed: Oct. 31, 1997

Related U.S. Application Data

[63] Continuation-in-part of application No. 08/752,359, Nov. 19, 1996, Pat. No. 5,787,978, and a continuation-in-part of application No. 08/590,747, Jan. 24, 1996, Pat. No. 5,727,629.

[51] Int. Cl.[7] ..... E21B 23/00

[52] U.S. Cl. ..... 166/297; 166/55.7; 175/403

[58] Field of Search ..... 166/55.7, 297, 166/55.1, 55.6; 175/249, 403, 404, 405.1

[56] References Cited

U.S. PATENT DOCUMENTS

| | | | |
|---|---|---|---|
| 1,524,265 | 1/1925 | Lester | 294/86.22 |
| 1,570,518 | 1/1926 | Mitchell | 166/117.5 |
| 1,615,037 | 1/1927 | Raymond . | |
| 1,636,032 | 7/1927 | Abbott . | |
| 1,901,453 | 3/1933 | Kelly . | |

(List continued on next page.)

FOREIGN PATENT DOCUMENTS

| | | |
|---|---|---|
| 0733775 | 9/1996 | European Pat. Off. . |
| 1 257 184 | 7/1961 | France . |
| 900 099 | 8/1958 | United Kingdom . |
| 898004 | 6/1962 | United Kingdom . |
| 2 307 704 | 6/1997 | United Kingdom . |
| WO 95 33910 | 12/1995 | WIPO . |
| WO 97 27380 | 7/1997 | WIPO . |
| WO 97 32110 | 9/1997 | WIPO . |

OTHER PUBLICATIONS

PCT/GB97/03104—Foreign Counterpart of this case U.S. 08/752,359—Invitation to Pay Additional Fees with Communication Relating to the Results of the Partial Int'l Search.

"Coring Services," Weatherford, 1994.

"Casing Whipstocks," Eastman Whipstock, Composite Catalog 1976–1977, p. 2226.

"Product Catalog," Weatherford Petco, 1992, especially pp. 26–30.

(List continued on next page.)

*Primary Examiner*—William Neuder
*Attorney, Agent, or Firm*—Guy McClung

[57] ABSTRACT

A wellbore mill has been invented that has a body having a top and a bottom and a first fluid flow channel extending longitudinally therethrough from top to bottom, the first fluid flow channel having an upper end and a lower end, the lower end of the first fluid flow channel having an opening sized for receiving a core of material from a tubular member milled by the mill, and at least a portion of the first fluid flow channel offset from the remainder thereof to facilitate separation of the core from the tubular member. A wellbore milling method for milling an opening in a selected tubular of a tubular string in a wellbore has been invented that includes installing a mill on a working string into the wellbore at a selected desired point for milling the opening in the tubular, the mill comprising a body having a top and a bottom and a first fluid flow channel extending longitudinally therethrough from top to bottom, the first fluid flow channel having an upper end and a lower end, the lower end of the first fluid flow channel having an opening sized for receiving a core of material from a tubular member milled by the mill, and at least a portion of the first fluid flow channel offset from the remainder thereof to facilitate separation of the core from the tubular member, and rotating the mill to mill the selected tubular, create the core by thus milling the tubular and separating the core from the tubular being milled.

39 Claims, 18 Drawing Sheets

U.S. PATENT DOCUMENTS

| | | | |
|---|---|---|---|
| 1,951,638 | 3/1934 | Walker . | |
| 2,014,805 | 9/1935 | Hinderliter . | |
| 2,065,896 | 12/1936 | Keever | 175/83 |
| 2,100,684 | 11/1937 | Carroll . | |
| 2,103,622 | 12/1937 | Kinzbach . | |
| 2,105,721 | 1/1938 | Cutrer et al. . | |
| 2,105,722 | 1/1938 | Barrett et al. . | |
| 2,108,419 | 2/1938 | Trotter . | |
| 2,158,329 | 5/1939 | Kinzback . | |
| 2,196,517 | 4/1940 | Bolton . | |
| 2,216,963 | 10/1940 | Sinclair | 175/82 |
| 2,281,414 | 4/1942 | Clark . | |
| 2,331,293 | 10/1943 | Ballard | 255/1.6 |
| 2,362,529 | 11/1944 | Barrett et al. | 156/117.6 X |
| 2,386,514 | 10/1945 | Stokes | 175/81 |
| 2,401,893 | 6/1946 | Williams, Jr. | 175/81 |
| 2,509,144 | 5/1950 | Grable . | |
| 2,514,585 | 7/1950 | Natland . | |
| 2,543,861 | 3/1951 | Mader . | |
| 2,553,874 | 5/1951 | Spaulding et al. . | |
| 2,633,682 | 4/1953 | Jackson . | |
| 2,766,010 | 10/1956 | Hester | 166/217 |
| 2,770,444 | 11/1956 | Neal . | |
| 2,807,440 | 9/1957 | Beck . | |
| 2,882,015 | 4/1959 | Beck . | |
| 2,885,182 | 5/1959 | Hering | 255/1.6 |
| 2,978,032 | 4/1961 | Hanna | 166/117.5 |
| 3,095,039 | 6/1963 | Kinzback | 166/117.6 |
| 3,172,488 | 3/1965 | Roxstrom . | |
| 3,552,505 | 1/1971 | Thompson et al. | 175/404 |
| 3,570,598 | 3/1971 | Johnson | 166/178 |
| 3,732,924 | 5/1973 | Chelete et al. | 166/55 |
| 3,743,036 | 7/1973 | Feenstra . | |
| 3,861,478 | 1/1975 | Condiolos . | |
| 3,908,759 | 9/1975 | Cagle et al. | 166/117.6 |
| 3,982,596 | 9/1976 | Vetter | 175/410 |
| 4,043,390 | 8/1977 | Glotin | 166/215 |
| 4,182,423 | 1/1980 | Ziebarth et al. | 175/61 |
| 4,234,048 | 11/1980 | Rowley . | |
| 4,266,621 | 5/1981 | Brock | 175/329 |
| 4,397,355 | 8/1983 | McLamore | 166/297 |
| 4,415,205 | 11/1983 | Rehm et al. | 299/5 |
| 4,420,049 | 12/1983 | Holbert | 175/45 |
| 4,552,229 | 11/1985 | Radford et al. | 175/240 |
| 4,553,613 | 11/1985 | Radford | 175/250 |
| 4,605,075 | 8/1986 | Radford et al. | 175/58 |
| 4,606,416 | 8/1986 | Knighton et al. | 175/58 |
| 4,607,710 | 8/1986 | Radford | 175/249 |
| 4,638,872 | 1/1987 | Park et al. | 175/46 |
| 4,651,835 | 3/1987 | Davis | 175/58 |
| 4,733,732 | 3/1988 | Lynch | 175/9 |
| 4,796,709 | 1/1989 | Lynde et al. | 166/55.6 |
| 4,807,704 | 2/1989 | Hsu et al. | 166/313 |
| 4,848,462 | 7/1989 | Allwin | 166/208 |
| 4,887,668 | 12/1989 | Lynde et al. | 166/55.8 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,010,955 | 4/1991 | Springer | 166/298 |
| 5,014,778 | 5/1991 | Lynde et al. | 166/55.6 |
| 5,035,292 | 7/1991 | Bailey et al. | 175/45 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,150,755 | 9/1992 | Cassel et al. | 166/297 |
| 5,199,513 | 4/1993 | Stewart et al. | 175/73 |
| 5,297,630 | 3/1994 | Lynde et al. | 166/297 |
| 5,335,737 | 8/1994 | Baugh | 175/61 |
| 5,373,900 | 12/1994 | Lynde et al. | 166/297 |
| 5,379,845 | 1/1995 | Blount et al. | 166/382 |
| 5,392,858 | 2/1995 | Peters et al. | 156/298 |
| 5,398,754 | 3/1995 | Dinhoble | 166/117.6 |
| 5,425,417 | 6/1995 | Carter | 166/117.6 |
| 5,425,419 | 6/1995 | Sieber | 166/206 |
| 5,427,179 | 6/1995 | Bailey et al. | 166/117.6 |
| 5,429,187 | 7/1995 | Beagrie et al. . | |
| 5,431,220 | 7/1995 | Lennon et al. | 166/55.7 |
| 5,437,340 | 8/1995 | Lee et al. | 175/61 |
| 5,443,129 | 8/1995 | Bailey et al. | 175/45 |
| 5,445,222 | 8/1995 | Pritchard et al. | 116/298 |
| 5,452,759 | 9/1995 | Carter et al. | 166/117.6 |
| 5,456,312 | 10/1995 | Lynde et al. | 166/55.6 |
| 5,467,820 | 11/1995 | Sieber | 166/117.6 |
| 5,474,126 | 12/1995 | Lynde et al. | 166/117.6 |
| 5,484,021 | 1/1996 | Hailey | 166/297 |
| 5,499,680 | 3/1996 | Walter et al. | 166/377 |
| 5,551,509 | 9/1996 | Braddick | 166/55.7 |
| 5,564,503 | 10/1996 | Longbottom et al. | 166/313 |
| 5,566,762 | 10/1996 | Braddick et al. | 166/382 |
| 5,566,763 | 10/1996 | Williamson et al. | 166/382 |
| 5,573,064 | 11/1996 | Hitsaw | 166/250.07 |
| 5,595,247 | 1/1997 | Braddick et al. | 166/297 |
| 5,647,436 | 7/1997 | Braddick | 166/298 |
| 5,647,437 | 7/1997 | Braddick et al. | 166/382 |
| 5,655,612 | 8/1997 | Grimes et al. | 175/401 |
| 5,655,614 | 8/1997 | Azar | 175/404 |
| 5,810,079 | 9/1998 | Lynde et al. | 166/55.6 |
| 5,829,539 | 11/1998 | Newton et al. | 175/393 |
| 5,833,003 | 11/1998 | Longbottom et al. | 166/298 |
| 5,845,707 | 12/1998 | Longbottom | 166/50 |
| 5,887,655 | 3/1999 | Haugen et al. | 166/55.7 |

OTHER PUBLICATIONS

"Bowen Whipstocks," Bowen Co., Composite Catalog, 1962–1963.

"Catalog 1958–59," Kinzbach Tool Co. 1958.

"Directional Drilling Tools," Homco Associated Oil Field Rentals, Composite Catalog 1964–1965, pp. 2391, 2392, 2394.

"Oilfield Services and Manufactrued Products," Homco, 1984.

"A–Z Stub Type Whipstock," A–Z Int'l Tool Co., 1976–1977 Composite Catalog, p. 219.

"Weatherford Fishing and Rental Tool Services," Weatherford, 1993.

"Improved Casing Sidetrack Procedure Now Cuts Wider, Longer Windows," Cagle et al, Petroleum Engr. Int'l Mar. 1979.

"Dual Horizontal extension drilled using retrievable whipstock," Cress et al, World Oil, Jun. 1993.

"1990–91 General Catalog," A–1 Bit & Tool Co., p. 9, 1990.

"TIW's SS–WS Whipstock Pakcer," Texas Iron Works, p. 111.9.18; 1986.

1 page, World Oil, Feb. 1, 1955.

65
66
62
64
60
63
71

55
12
55

56
57
52
52
54
50
58

14
91

48
40
44
47
42

88
84
80
86

300
302
304
306
308
310
312
314
320
322
324
326
328
330
332
334
336
337
338
339
340
342
344
346
348
350
352
354
356
358

WELLBORNE MILLS & METHODS

RELATED APPLICATION

This is a continuation-in-part of U.S. Application Ser. No. 08/752,359 filed Nov. 19, 1996, now U.S. Pat. No. 5,787,978, entitled "Multi-Face Whipstock With Sacrificial Face Element" and of U.S. application Ser. No. 08/590,747 filed Jan. 24, 1996, now U.S. Pat. No. 5,727,629, entitled "Welilbore Milling Guide."

U.S. application Ser. No. 08/590,747 is a continuation-in-part of U.S. Pat. Nos. 5,531,271, issued Jul. 2, 1996; 5,425,417, issued Jun. 20, 1995; 5,409,060, issued Apr. 25, 1995; 5,452,759, issued Sep. 26, 1995; and 5,429,187, issued Jul. 4, 1995.

U.S. Application Ser. No. 08/752,359 is a continuation-in-part of U.S. Pat. Nos. 5,620,051 issued Jun. 3, 1996 and 5,522,461 issued Mar. 31, 1995; and of U.S. Application Ser. No. 08/542,439 filed Oct. 12, 1995.

All of the above-mentioned patents and patent applications are incorporated fully herein for all purposes.

BACKGROUND OF THE INVENTION

1. Field of the Invention

This invention is related to milling processes, milling tools and whipstocks; and in one aspect to milling processes which employ a whipstock. In certain embodiments two-trip and single-trip milling methods and systems are disclosed.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like.

Prior art sidetracking methods use cutting tools of the type having cutting blades and use a deflector such as a whipstock to cause the tool to be moved laterally while it is being moved downwardly in the well during rotation of the tool to cut an elongated opening pocket, or window in the well casing.

Certain prior art well sidetracking operations which employ a whipstock also employ a variety of different milling tools used in a certain sequence. This sequence of operation requires a plurality of "trips" into the wellbore. For example, in certain multi-trip operations, a packer is set in a wellbore at a desired location. This packer acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

There has long been a need for an efficient and effective milling method in which the number of trips into the wellbore is reduced. There has long been a need for tools useful in such methods. There has long been a need for milling methods in which various items are easily and properly oriented in a wellbore. There has long been a need for tools useful in such orientation.

SUMMARY OF THE PRESENT INVENTION

The present invention, in one embodiment, discloses a well sidetracking operation which uses a tool including a whipstock with a concave face; a starting bar releasably secured to the whipstock, and in one aspect secured to the concave face; and a milling apparatus including one or more milling tools and having a central opening for receiving an end of the starting bar and a hollow interior for receiving a substantial portion of the body of the starting bar as milling proceeds, the starting bar guiding the mill(s) as the milling apparatus is moved downwardly toward the whipstock. In one embodiment the tool includes a hollow window mill mounted below a hollow finishing mill, with a hollow pup joint (e.g. fifteen feet long) connected to the finishing mill. The pup joint receives the starting bar (which has passed through the hollow mills), casing sliver and a core. A portion of the casing that enters into and is held within the pup joint and within the hollow mill(s) is an amount of casing that does not need to be and is not milled by the milling tools. In other words, as the hollow mill (or mills) with an opening in the bottom end move down, as viewed from above, there is not cutting or milling occurring at the mill(s)'s center where the opening is located; so the mill cuts two slots or lines down a side of the casing (when it is not on high center). The portion of casing between the slots or lines simply moves up into the mills and into the pup joint and the mills do not mill this portion of casing. In certain embodiments at least a portion of a corecatching channel in the mill body is off center to facilitate movement of the mill away from a top-dead-center position with respect to the mill, thereby inhibiting damaging "coring" of the mill. Coring occurs when the piece of tubular moving up into a mill damages the mill and/or the mill is unable to cut or twist off such a piece.

In one embodiment apparatus is provided for securing the starting bar to the milling apparatus so that the starting bar does not fall out of the milling apparatus once it has been received therein. For example, a retaining spring or snap ring with one or more fingers mounted in the finishing mill is disposed and configured to snap into a groove or recess on the starting bar once the starting bar has moved sufficiently into the milling apparatus (and into an interconnected hollow tubular, e.g. a pup joint) to position the groove or recess adjacent the spring or ring.

In one embodiment, a core catcher mounted between the mills is used to catch and hold a core, a piece of casing, slivers milled from the casing, and other debris so that they are removed from the wellbore when the tool is removed.

In one embodiment a packer whipstock is used in conjunction with an anchor packer and the whipstock is oriented using an orienting stinger on the bottom end thereof.

In one embodiment in which apparatus according to this invention is used in a single-trip milling method, a pin or bar extending through a hole in the top of the starting bar initially prevents the first hollow mill (lowest mill) from further pushing down around the starting bar. Initially the mill receives and holds only a top portion of the starting bar. The mill contacts and pushes against the pin so that the whipstock and associated apparatus is moved down onto the anchor packer. When milling commences, the first mill (e.g. a window mill) mills off this pin. Preferably the multiple hollow mills rotate and move down the whipstock to cut out a desired window without requiring any further tool trips into the wellbore.

In another embodiment of the present invention a two-trip milling method is disclosed in which on a first trip apparatus including a starting mill secured to a top of a whipstock concave member with a shear bolt is run into a cased wellbore. This apparatus is run into a cased wellbore to contact an anchored device such as an anchor packer. After the apparatus is anchored on the anchor device and oriented, milling commences and the starting mill, after shearing the shear bolt, mills out an initial pocket in the casing. The starting mill is then removed. For the second trip into the wellbore, a tool as previously described including everything above the starting bar (but without a starting bar) is run into the wellbore and used as previously described, swallowing an unmilled portion of the casing and other material.

The present invention discloses, in certain embodiments, a wellbore mill having a body having a top and a bottom and a first fluid flow channel extending longitudinally therethrough from top to bottom, the first fluid flow channel having an upper end and a lower end, milling apparatus on the body, the lower end of the first fluid flow channel having an opening sized for receiving a core of material from a tubular member milled by the mill, and at least a portion of the first fluid flow channel offset from the remainder thereof to facilitate separation of the core from the tubular member; such a mill with at least one side fluid flow channel having an inner end in fluid communication with the first fluid flow channel and an outer end in fluid communication with a space outside the mill so that fluid pumped down the first fluid flow channel flows out into the space; any such mill wherein the first fluid flow channel includes an upper portion and a lower portion, the upper portion extending through the body of the mill and the lower portion extending through the body of the mill at an angle to the upper portion so that separation of a core with an upper end passing through the lower portion and into the upper portion is facilitated by receipt of said core upper end in the upper portion of the first fluid flow channel; any such mill with the mill body including a top body and a bottom body connected to the top body, the top body including the upper portion of the first fluid flow channel and the bottom body including the lower portion of the first fluid flow channel; any such mill with a coupling interposed between and connecting together the top body and the bottom body, the coupling having a coupling fluid flow bore therethrough in fluid communication with the upper portion of the first fluid flow channel of the top body and with the lower portion of the first fluid flow channel of the bottom body; any such mill wherein the coupling fluid flow bore has an inner diameter larger than an inner diameter of the upper portion of the first fluid flow bore and larger than an inner diameter of the lower portion of the first fluid flow bore; any such mill wherein the upper portion of the first fluid flow bore is offset from the lower portion of the first fluid flow bore, the coupling disposed so that entry of a core top end into the upper portion of the first fluid flow bore is inhibited, the core top end passing from the lower portion of the first fluid flow bore into the coupling fluid flow channel; any such mill wherein the lower portion of the first fluid flow channel has a lower opening at a bottom of the body; any such mill wherein the lower opening is located substantially at a center of a lower portion of the body; any such mill wherein the lower portion of the first fluid flow channel is located substantially at a center of the body, the upper portion thereof is offset from said center, and the first fluid flow channel has an intermediate portion interconnecting the upper and lower portions and at an angle to each of said upper and lower portions; any such mill wherein a first portion of the first fluid flow channel is located substantially at a center of the body, a second portion thereof is offset from said center, and the first fluid flow channel has an intermediate portion interconnecting the first and second portions and at an angle to each of said first and second portions; any such mill wherein the body has a center at its lowest portion and the lower opening is offset from said center; any such mill wherein the body has a lower end with a lower surface thereacross, said lower surface inclined upwardly from an outer edge of the lower end up to a central point of the lower end to facilitate movement of the mill outwardly from a tubular member being milled in a wellbore; any such mill wherein the body has a lower end having an outer lower surface around a circumference of the body, said outer lower surface tapering inwardly from a level above a lowest boundary of the lower end to said lowest boundary; any such mill wherein the body has a lower end with an extended outer circumferential surface positionable substantially parallel to and for co-acting with an inner surface of a mill guide in a wellbore; any such mill including a mill guide in contact with the body of the wellbore mill, said mill guide having hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide.

The present invention discloses, in certain embodiments, a wellbore milling method for milling an opening in a selected tubular of a tubular string in a wellbore, the method including installing a mill on a working string into the wellbore at a selected desired point for milling the opening in the tubular, the mill having a body with milling apparatus thereon and having a top and a bottom and a first fluid flow channel extending longitudinally therethrough from top to bottom, the first fluid flow channel having an upper end and a lower end, the lower end of the first fluid flow channel having an opening sized for receiving a core of material from a tubular member milled by the mill, and at least a portion of the first fluid flow channel offset from the remainder thereof to facilitate separation of the core from the tubular member, and rotating the mill to mill an opening in the selected tubular; such a wellbore milling method including creating a core of material of the selected tubular member by milling down the selected tubular, said core received through said opening into at least the lower end of the first fluid flow channel, and separating with said mill said core from said selected tubular member; any such milling method including positioning a mill guide in said tubular string in said wellbore, said mill guide comprising a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide, and urging said mill toward said selected tubular with said mill guide; any such milling method wherein there is at least one side fluid flow channel having an inner end in fluid communication with the first fluid flow channel and an outer end in fluid communication with a space outside the mill so that fluid pumped down the first fluid flow channel flows out into the space and the method also including pumping fluid out from the outer end of the side fluid flow channel to move milled material up away from the mill; any such wellbore milling method including positioning a whipstock in said tubular string in said wellbore, and contacting said whipstock with said mill to divert said mill toward said selected tubular; any such milling method including rotating said mill with a downhole motor disposed in said working string; any such milling method wherein the working string is a string consisting of tubulars from the group consisting of pipe and coiled tubing.

The present invention discloses, in certain embodiments, a wellbore mill having a mill body with milling apparatus thereon and a top and a bottom and a side exterior surface, at least one flushing fluid flow channel extending down from the top of the body to an exit opening on the side exterior surface, fluid pumpable from above the wellbore mill down into the flushing fluid flow channel and out from the exit opening to move material milled by the wellbore mill up away from the wellbore well, and a core channel extending from a bottom center opening at a bottom of the mill body and up thereinto for receiving a core of material from a tubular milled by the wellbore mill, the core channel at an angle to a longitudinal axis of the mill body; such a wellbore mill wherein the core channel has a top end within the mill body beyond which the core does not move or the core channel having a core channel opening on the side exterior surface through which a portion of the core may move; any such wellbore mill with at least one intermediate fluid flow channel within fluid communication with the at least one flushing fluid flow channel and the core channel for providing flushing fluid into the core channel; any such wellbore mill wherein the at least one intermediate fluid flow channel is at an angle of at least 90° to the core channel; any such wellbore mill with a mill guide in contact with the body of the wellbore mill, the mill guide having a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide.

The present invention discloses, in certain embodiments, a wellbore mill with a body having a top and a bottom, milling apparatus on the body, and a core bore insert channel extending up from the bottom of the body for receiving a core bore insert for holding therein; any such wellbore mill with a first core bore insert within the core bore channel, the first core bore insert having a first core channel therethrough with a first diameter for receiving a core milled from a wellbore tubular; any such wellbore mill wherein the core bore insert is removably held in the core bore channel; any such wellbore mill with at least one second core bore insert emplaceable in the core bore insert channel of the wellbore mill body, the at least one second core bore insert having an inner diameter different from the first diameter of the first core bore insert; any such wellbore mill wherein an amount of milling material is on the lower end of, the entire surface of, or at least a portion of the first core channel to facilitate separation of a core from a tubular.

The present invention discloses, in certain embodiments, a first core bore insert for insertion within a core bore insert channel in a body of a wellbore mill, the core bore insert having a body with a top and a bottom, a first core channel extending from the bottom of the body toward the top and having a first length and a first core channel inner diameter, and the first core channel sized to receive a core milled from a wellbore tubular by the wellbore mill; such a first core bore insert with milling material on all of, the lower end of, or at least a portion of the core channel to facilitate separation of a core from a tubular; any such first core bore insert including at least one additional core bore insert, said at least one additional core bore insert having an inner diameter different than the first core channel inner diameter; any such first core bore insert with at least one additional core bore insert, said at least one additional core bore insert having a length different than the first length; and any such core bore insert wherein a core bore channel extends all the way through the body of the core bore insert from top to bottom.

It is, therefore, an object of at least certain preferred embodiments of the present invention to provide:

New, useful, unique, efficient, non-obvious wellbore mill, milling systems, and methods for milling operations;

Milling apparatus with which milling on high center of a tubular or casing is inhibited;

A wellbore mill having a core receiving channel with at least a portion thereof off-center with respect to a body of the mill; and Any such mill with one or more side fluid flow ports to facilitate the removal of milled material from the wellbore.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIGS. 1D–1H are in cross-section.

DESCRIPTION OF EMBODIMENTS PREFERRED AT THE TIME OF FILING FOR THIS PATENT

Figures 1A, 1B:
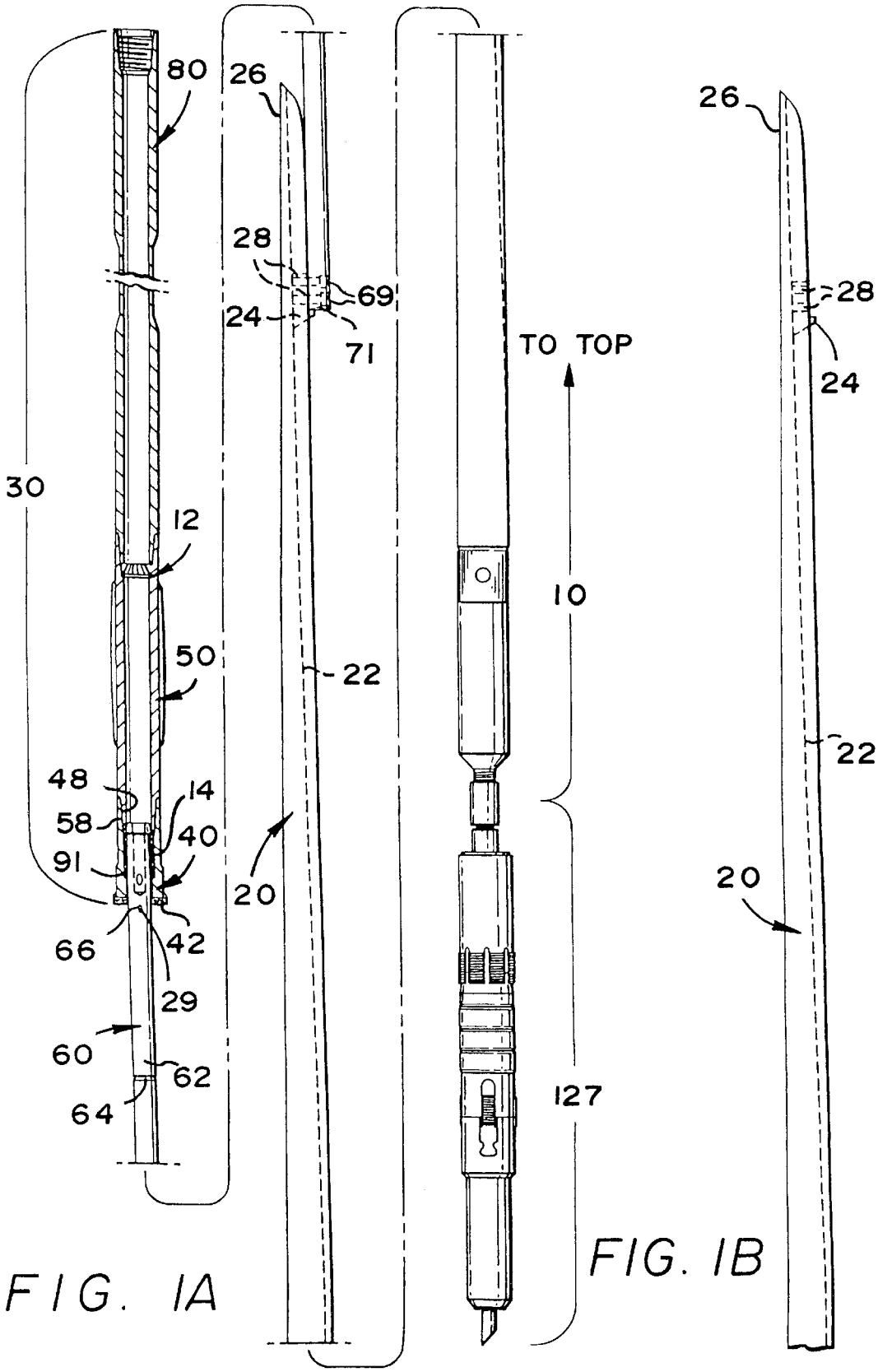
FIG. 1A–1H are side views of parts of a milling system according to the present invention.

Referring now to FIGS. 1A–1H and 2A and 2B, a tool 10 according to the present invention has a whipstock 20 according to the present invention with a pilot block 24 welded near a top 26 thereof. The whipstock has a concave face 22. The pilot block 24 has bolt holes 28.

The tool 10 has a starting bar 60 which has a body 62 which is secured to the whipstock 20 by bolts 69 through holes 63 extending into holes 28 in the pilot block 24. A groove 64 encircles the body 62. A stop bar 29 (see FIG.4) extends through a stop pin hole 66.

The tool 10 has the milling apparatus 30 which includes at least one and preferably two or more mills so that a milling operation for producing a sidetracking window in casing can be accomplished in a dual or single tool trip into a cased wellbore. As shown in FIG. 1 and 2, the milling apparatus 30 includes a starting mill 40 connected to and below a hollow finishing mill 50. Interior threads 48 of the starting mill 40 engage exterior threads 58 of the finishing mill 50.

The starting mill 40 has a central channel 44 therethrough and a cutting end with carbide cutters 42. A core catcher 14 is disposed within the starting mill 40 and rests on a shoulder 47 to receive and hold debris such as an initial casing sliver, etc. The core catcher 14 is a typical two-piece core catcher.

Figures 1C, 1D, 1E, 1F, 1G, 1H:
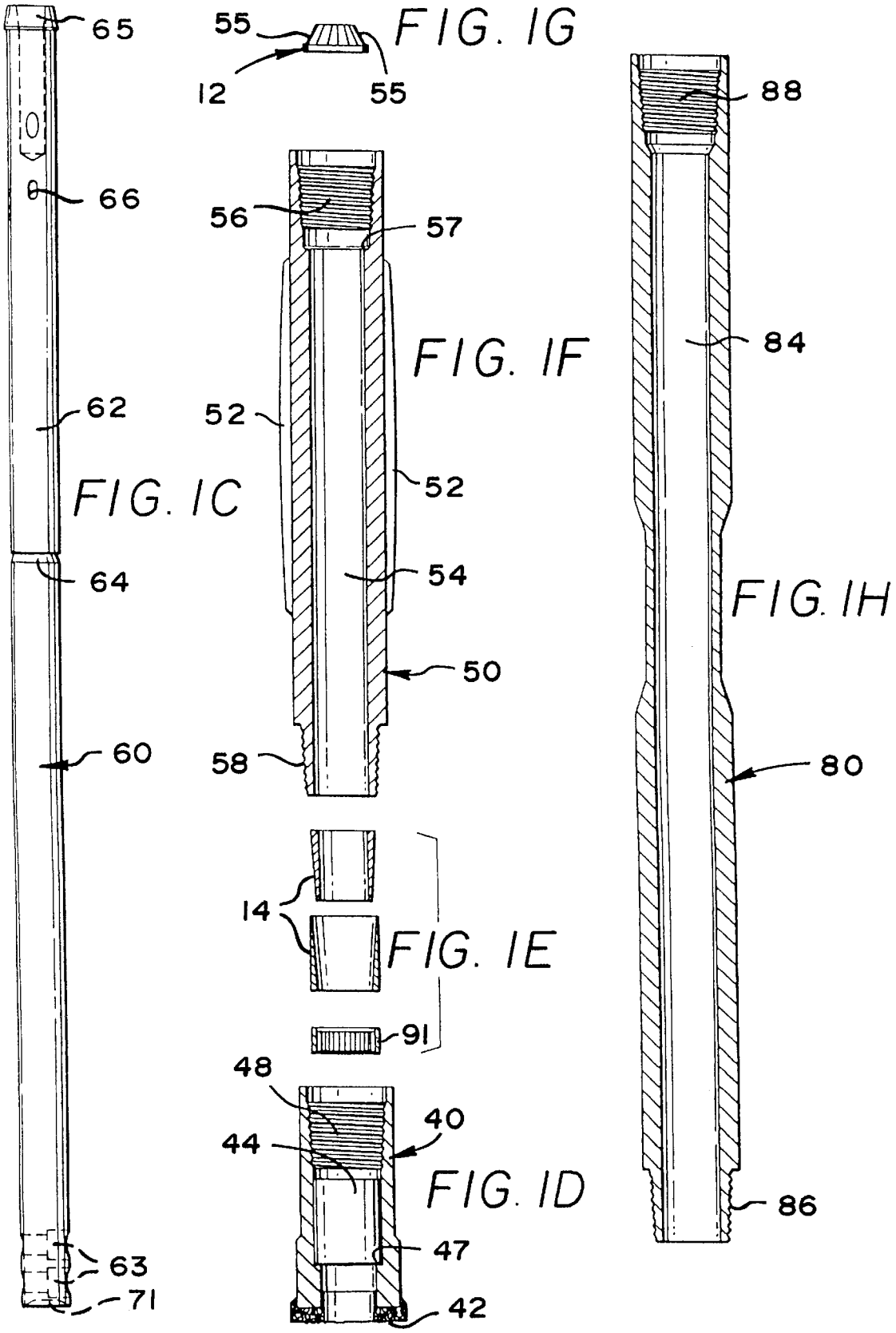

The finishing mill 50 has a plurality of milling blades 52 and a central channel 54 therethrough. A retainer 12 is disposed within the channel 54 and rests on a shoulder 57 of the mill 50. The retainer 12, as shown in FIG. 1G, preferably is a spring with a plurality of fingers 55 which are disposed so that the fingers 55 protrude into the groove 64 of the starting bar 60, preventing the starting bar 60 from moving downwardly from the position shown in FIG. 4.

To accommodate a substantial portion of the starting bar 60 when its length exceeds that of the combined lengths of the mill(s), a pup joint may be used such as the pup joint 80. External threads 86 on the lower end of the pup joint 80 engage upper internal threads 56 of the finishing mill 50. Upper internal threads 88 of the pup joint engage a part of a drill string (not shown) e.g. a crossover sub with a mud motor above it. A central channel 84 extends through the pup joint and is sized and configured to receive a portion of the starting bar 60.

Figure 2A:
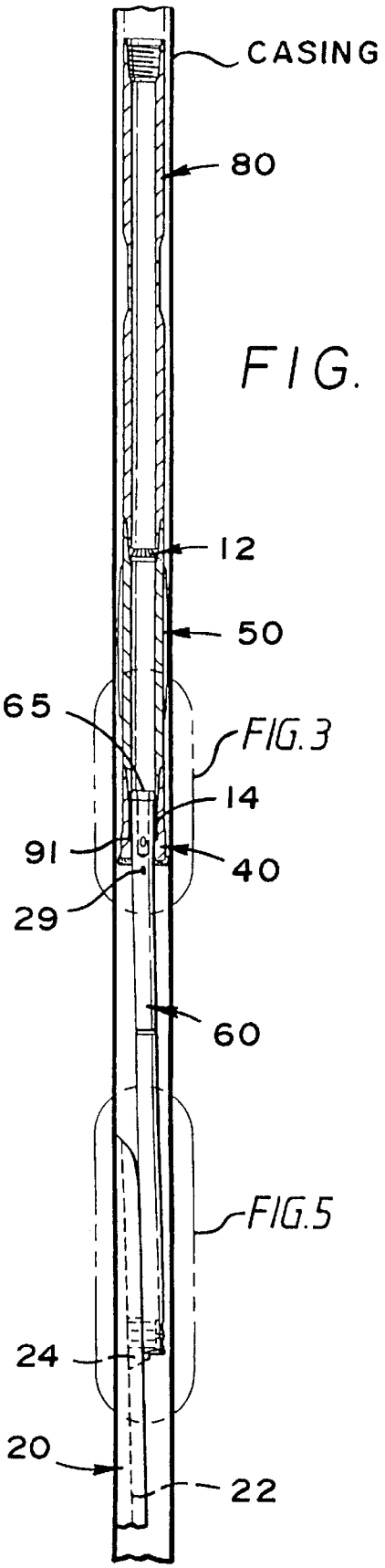
FIGS. 2A and 2B show the milling system including the parts shown in FIGS. 1A–1H and show steps in the operation of the system.
Figure 2B:
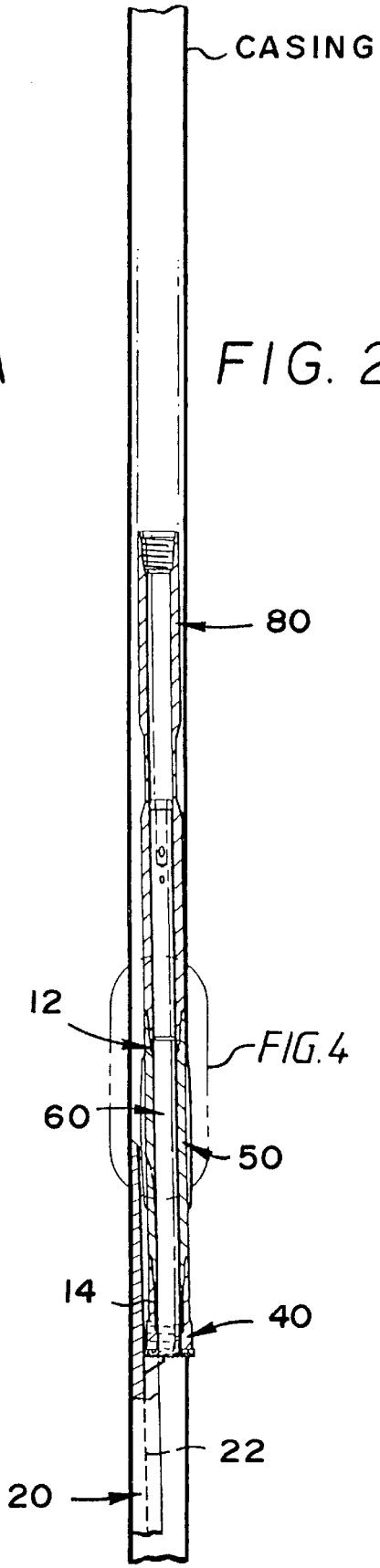
Figure 3:
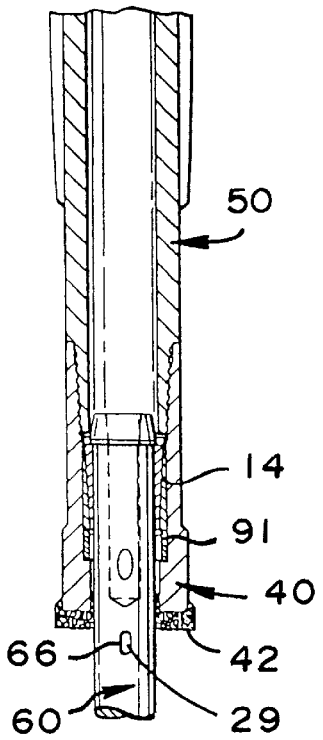
FIG. 3 is an enlarged view of part of the tool show in FIG. 2A.

FIGS. 2A and 2B illustrate steps in the use of a tool 10 according to this invention. As shown in FIG. 2A, the milling apparatus 30 has a top portion 65 of the starting bar 60 within the starting mill 40 and the starting bar 60 is secured to the whipstock 20. As shown in FIG. 2B the starting mill 40 and apparatus above it have pushed down on the bar 29, breaking it, and permitting the milling apparatus 30 to receive a substantial portion of the starting bar 60. The starting mill 40 has moved to contact the pilot block 24 and mill off the bar 29.

Figure 4:
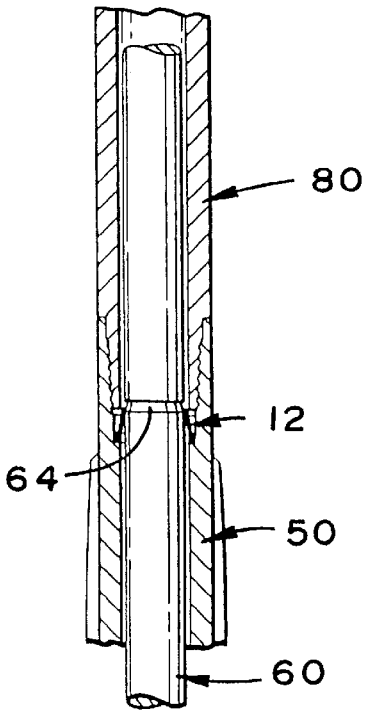
FIG. 4 is an enlarged view of a part of the tool shown in FIG. 2B.
Figure 7:
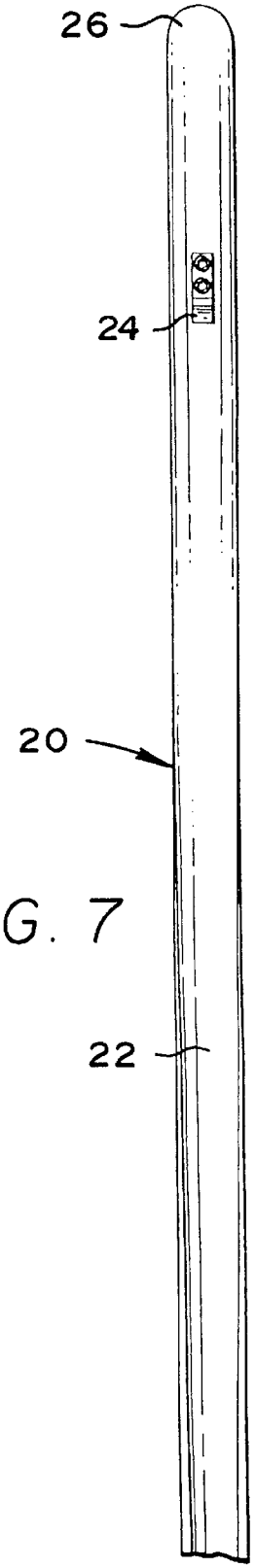
FIG. 7 is a side view of the whipstock concave member of the tool of FIG. 2A
Figure 5:
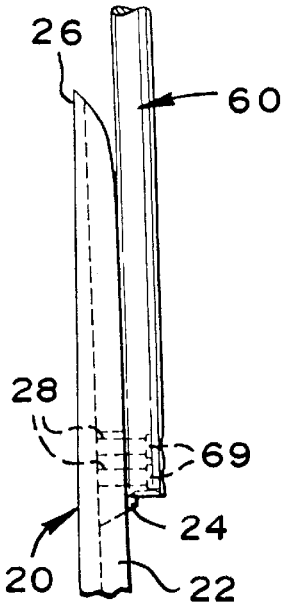
FIG. 5 is an enlarged view of a portion of the tool of FIG. 2A.
Figure 6:
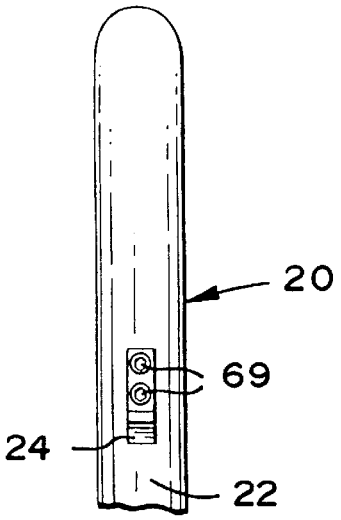
FIG. 6 is a side view of the tool as shown in FIG. 5.
Figure 8:
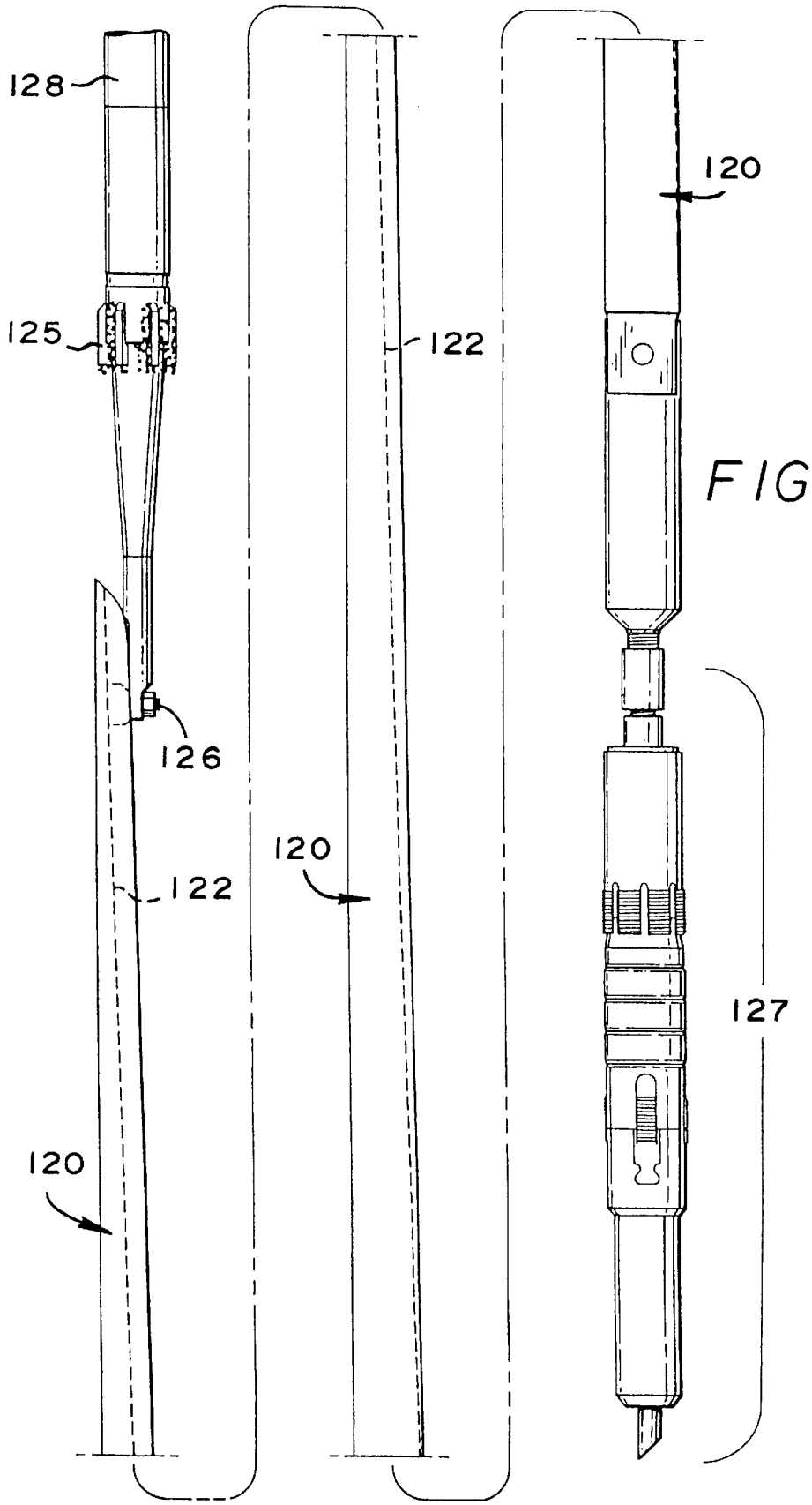
FIG. 8 is a side view of apparatus according to the present invention.

Milling now commences and the starting mill 40 mills through the pilot block 24. As the starting mill moves down the concave face of the concave member 20, the concave member 20 is moved sideways in the casing (add casing to FIGS. 2A, 2B) (to the left in FIGS. 2A and 2B) and a window is begun in the casing's interior wall. As shown in FIG. 4 the fingers 55 have entered the groove 64, preventing the starting bar 60 from falling out of the apparatus or from being pumped out by circulating well fluid. The starting bar 60 has an indented end 71 to facilitate entry of a core into the mill.

To move cutting and debris out of the wellbore a circulation fluid is, preferably, circulated downhole through the drill pipe, outside of and past the starting bar between the starting bar's exterior and the mills' interiors, past the core catcher, past a splined bearing 91, past the starting mill between its exterior and the casing's interior and back up to the surface.

As the milling apparatus mills down against the concave member, the finishing mill 50 smooths the transition from the casing edge to the wellbore to complete the milling operation. Then the milling apparatus is removed from the wellbore with the starting bar 60, casing sliver, debris, and core held within the interior of the mills.

Figure 9A:
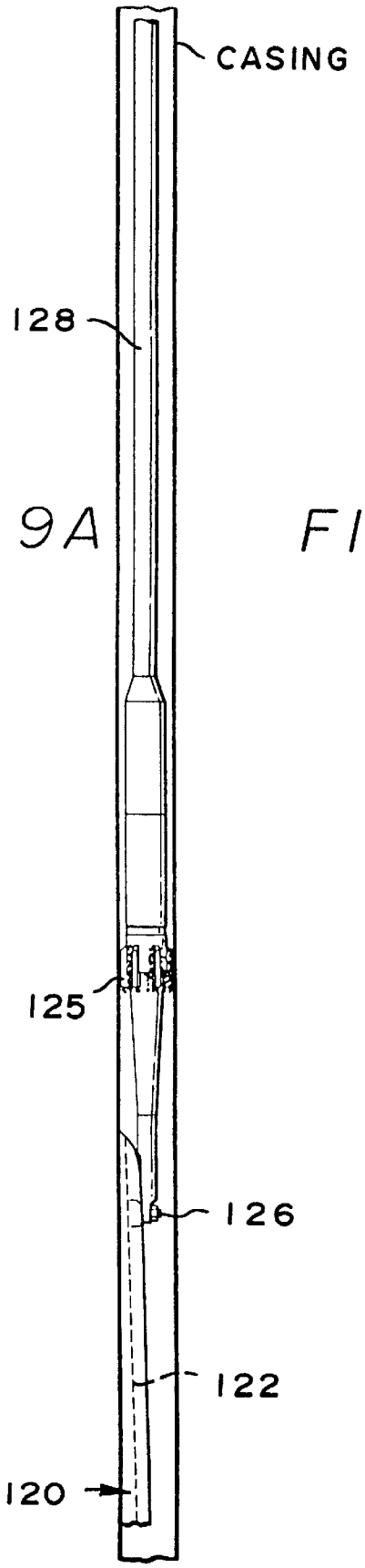
FIG. 9A is a side view of apparatus used in a method according to the present invention.
Figure 9B:
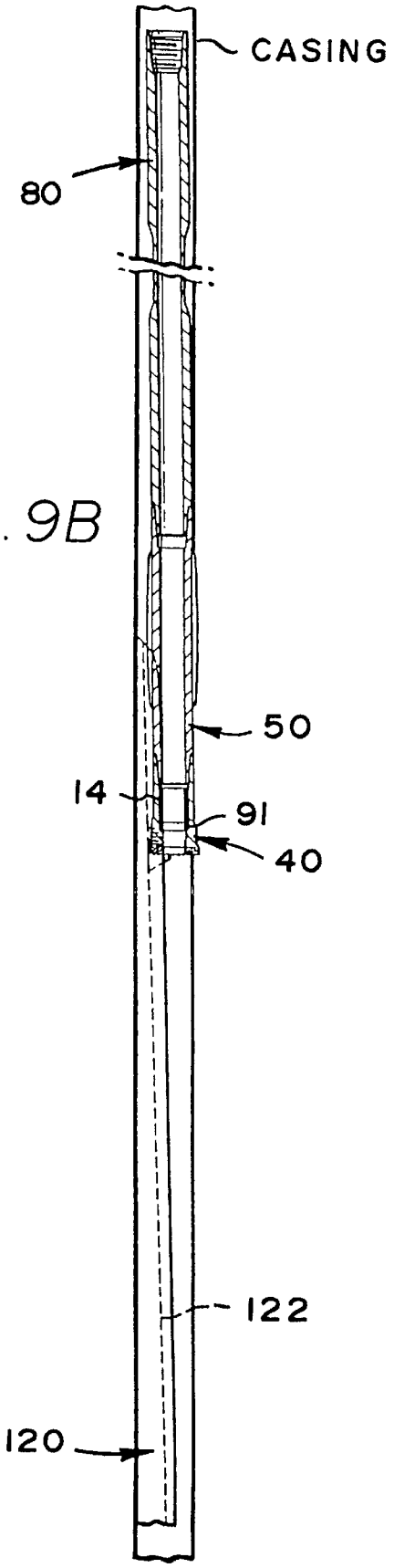
FIG. 9B is a side view of apparatus used in a method according to the present invention.

As shown in FIGS. 9A and 9B, in a two-trip milling operation according to the present invention, a tool 120 including a whipstock concave member 122 and a starting mill 125 secured thereto with a sheer stud 126 is run into a cased wellbore in which some type of anchoring-orientation device, e.g. a keyed packer (not shown), has been installed. Upon emplacement and orientation of the tool 120, the shear stud 126 is sheared by pushing down on the tool and milling is commenced producing an initial window or pocket in the casing. The tool 120 is removed leaving the whipstock concave member 122 in place and then a milling system (like the system shown in FIG. 2B) is run into the hole to continue milling at the location of the initial window or pocket. This milling system includes the items above the starting bar 60 in FIG. 2A, but not the starting bar 60; and the milling system, as shown in FIG. 9B, is used as previously described but without the starting bar. This two-trip operation results in a finished window through the casing.

Figure 10:
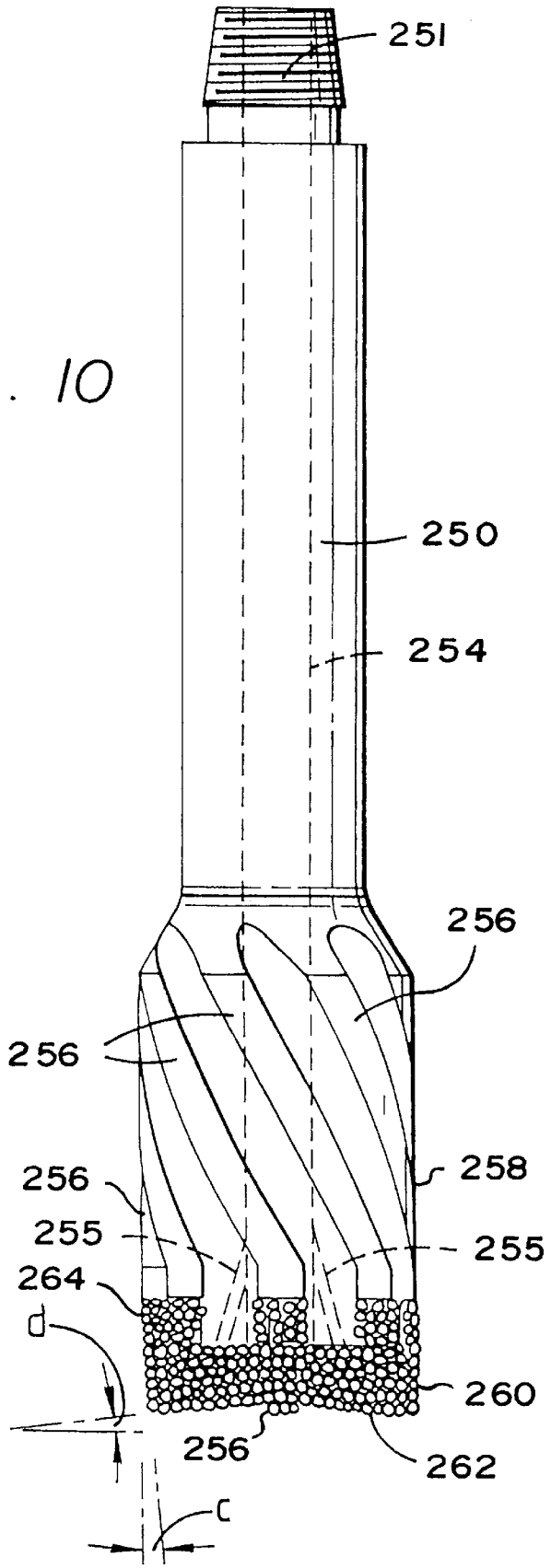
FIG. 10 is a side view of a mill according to the present invention.

FIG. 10 shows a window mill 250 for use to enlarge the window made by a mill, including but not limited to the mill 200. The window mill 250 has a body 252 with a fluid flow channel 254 from top to bottom and jet ports 255 to assist in the removal of cuttings and debris. A plurality of blades 256 present a smooth finished surface 258 for movement along a sacrificial element, along the filler in a whipstock, and/or on edges of a whipstock that define a recess with or without filler material therein. Lower ends of the blades 256 and a lower portion of the body 252 and the interior surface of the central flow bore (see FIG. 11E) are dressed with milling material 260 (e.g. but not limited to known milling matrix material and/or known milling/cutting inserts applied in any known way, in any known combination, and in any known pattern or array).

In one aspect the lower end of the body 252 tapers inwardly an angle C. In one aspect such a structure inhibits or prevents the window mill lower end from contacting and milling filler and a whipstock body as disclosed in U.S. Application Ser. No. 08/752,359.

In one aspect the surface 258 is about fourteen inches long and, when used with the mill 200 having blades about two feet apart as described above, an opening of about five feet in length is formed in the casing when a sacrificial element in a whipstock (e.g. as in U.S. Application Ser. No. 08/752, 359) has been completely milled down. In this embodiment the window mill 250 is then used to mill down another ten to fifteen feet so that a completed opening of fifteen to twenty feet is formed, which includes a window in the casing of about eleven to fifteen feet and a milled bore into formation adjacent the casing of about five to nine feet.

In one embodiment the lower ends of the blades of the window mill body 252 taper upwardly from the outer surface toward the body center an angle d (FIG. 10). This taper part tends to pull the body 252 outwardly in a direction away from filler, and away from a whipstock body (e.g. as in U.S. Application Ser. No. 08/752,359) into the formation adjacent the casing, acting like a mill-directing wedge ring. Also this presents a ramp to the casing which is so inclined that mill end tends to move down and radially outward (to the right in FIG. 11E) rather than toward the whipstock.

In one method according to the present invention a mill (such as the window mill 250) mills down the whipstock, milling a window. Following completion of the desired window in the casing and removal of the window mill, a variety of sidetracking operations may be conducted through the resulting window (and, in some aspects, in and through the partial lateral wellbore milled out by the mill as it progressed out from the casing). In such a method the remaining portion of the whipstock is left in place and may, if desired be milled out so that the main original wellbore is again opened. In one aspect filler and a plug element (e.g. as in U.S. Application Ser. No. 08/752,359) are milled out to provide an open passage through the whipstock.

Figure 11A:
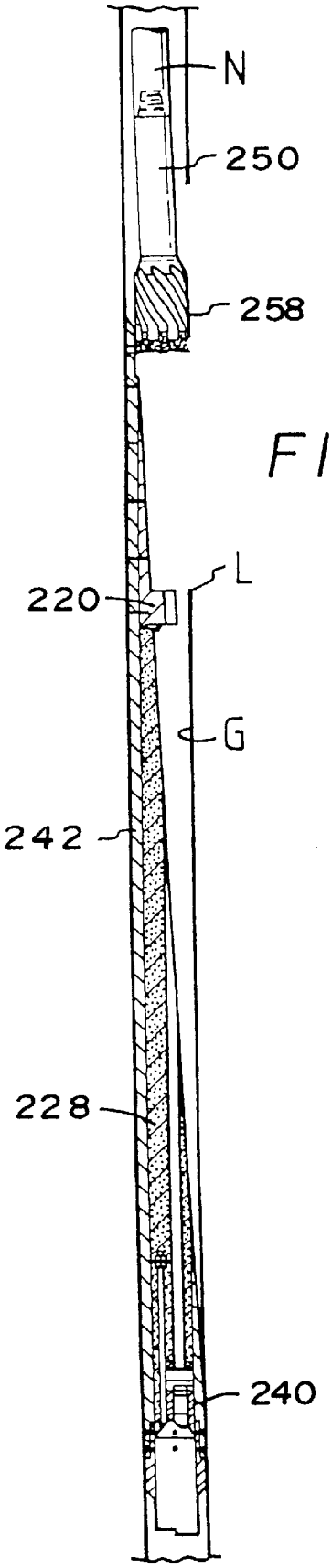
FIGS. 11A–11E show operation of a system with a mill as in FIG. 4.

As shown in FIG. 11A, the mill 250 (FIG. 10) has been run into a wellbore (e.g. on a tubular string N of, e.g. a drill string of drill pipe to be rotated from above or to be rotated with a downhole motor as described above). The inwardly tapered portion 260 of the body 252 of the mill 250 preferably does not mill the top of a whipstock body 242 or mills it minimally.

Figure 11B:
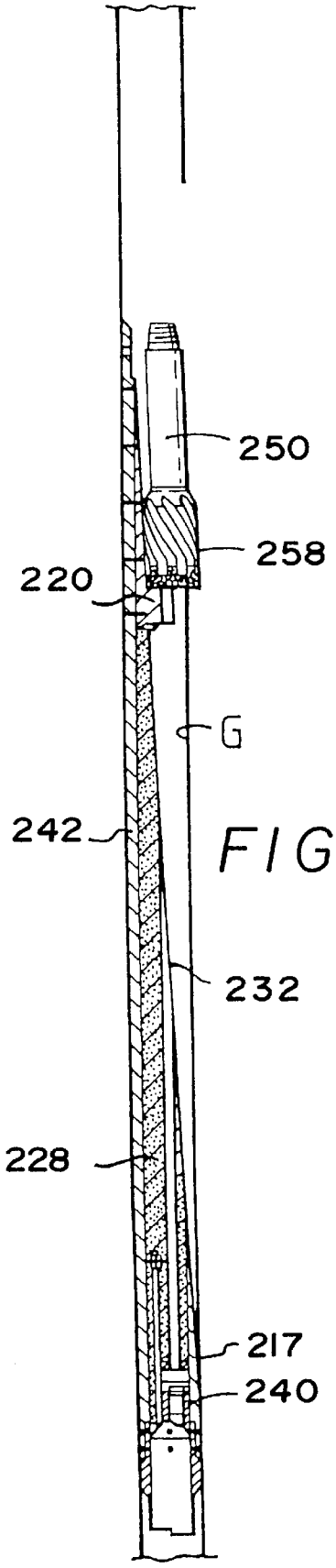
Figure 11C:
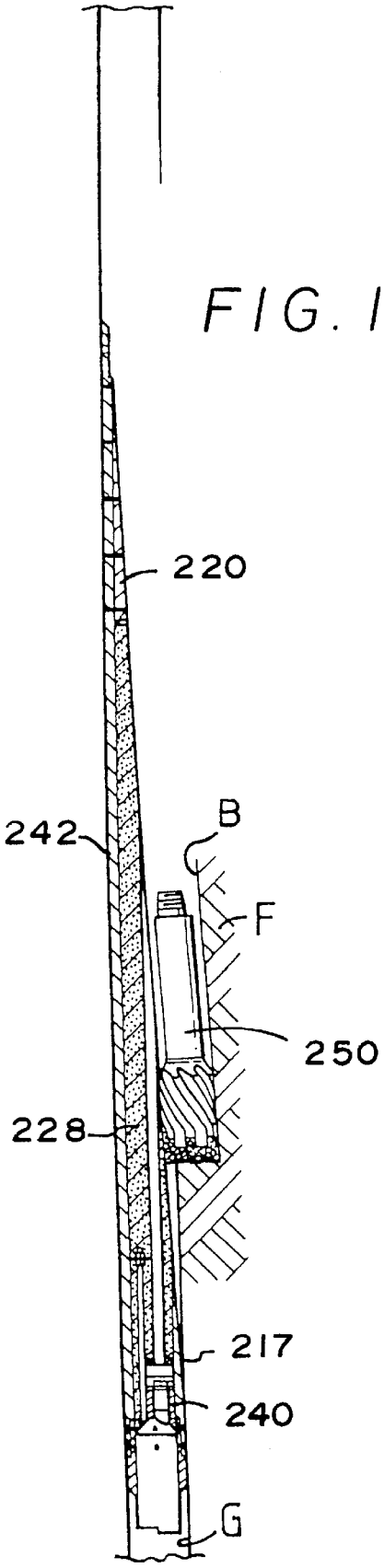

As shown in FIG. 11B the mill 250 proceeds down along the remainder of a sacrificial element 220 with the mill surface 258 holding the milling end away from the sacrificial element and directing the mill 250 away from the body 242 toward a casing G. The inwardly tapered portion of the mill 250 (tapered at angle d, FIG. 10) encounters a ledge L previously created, by e.g. a starting mill or a mill e.g. as disclosed in U.S. Application No. 08/752,359, and due to the inwardly tapered portion, the mill moves outwardly with respect to the ledge L, begins to mill the casing G, and also begins to mill the remainder of the sacrificial element 220. The surface 258 will continue to co-act with the resulting milled surface on the sacrificial element 220 until the surface 258 is no longer in contact with the sacrificial element 258 as the mill 250 mills down the casing G. Thus the window, (at the point at which the mill 250 ceases contact with the sacrificial element 220) that includes the initial window previously formed by another mill and the additional portion milled by the mill 250 is created without the mills contacting the whipstock body 242 or filler 228 therein. The tubular string N is present, but not shown, in FIGS. 11B–11F. The mill 250 may be used with any known mill diverter or whipstock or in a string which is otherwise inclined or urged into contact with a tubular to be milled.

As shown in FIG. 4, the mill 250 has continued to mill out the window in the casing G and has both contacted the whipstock body 242 and begun to mill a bore B into the formation F (e.g. a bore suitable for sidetracking operations). In a whipstock in which side rails define sides of a recess in the whipstock, as in U.S. Application Ser. No. 08/752,359, preferably the surface 258 of the mill 250 is contoured, configured and shaped to correspond to a curved shape presented by the rails so that these parts of the body 242 have more than point contact and effectively direct the mill 250 away from the whipstock. A radiused face 232 of the whipstock body 242 and filler 228 also assists in directing the mill 250 at a desired angle away from the whipstock. Eventually the mill 250 contacts a straight (non-radiused) face 217 of the whipstock body and filler material 228.

Figure 11D:
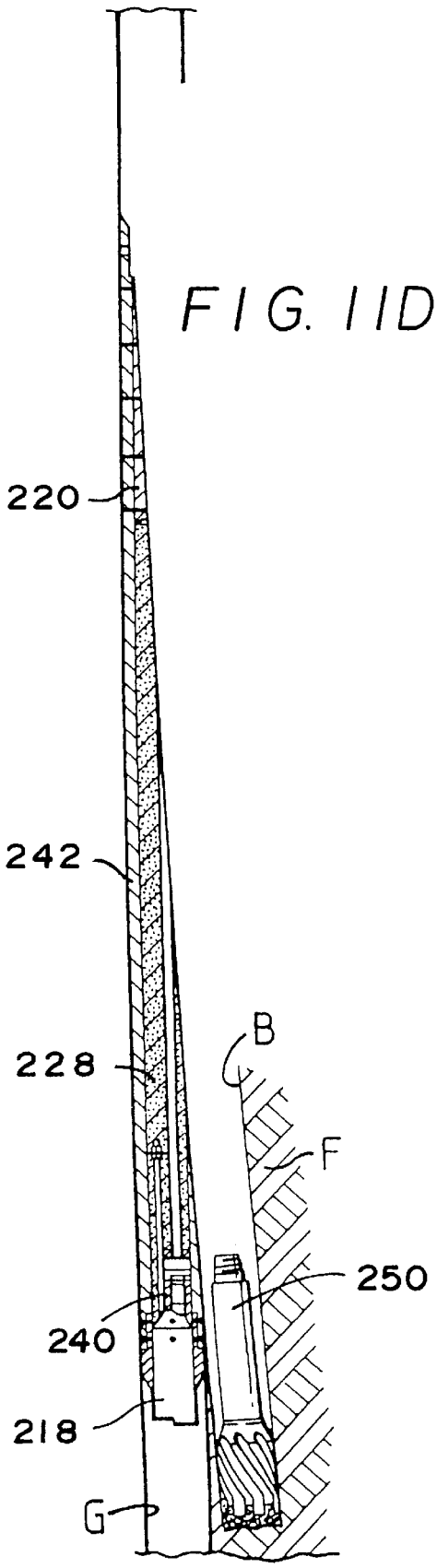
Figure 11E:
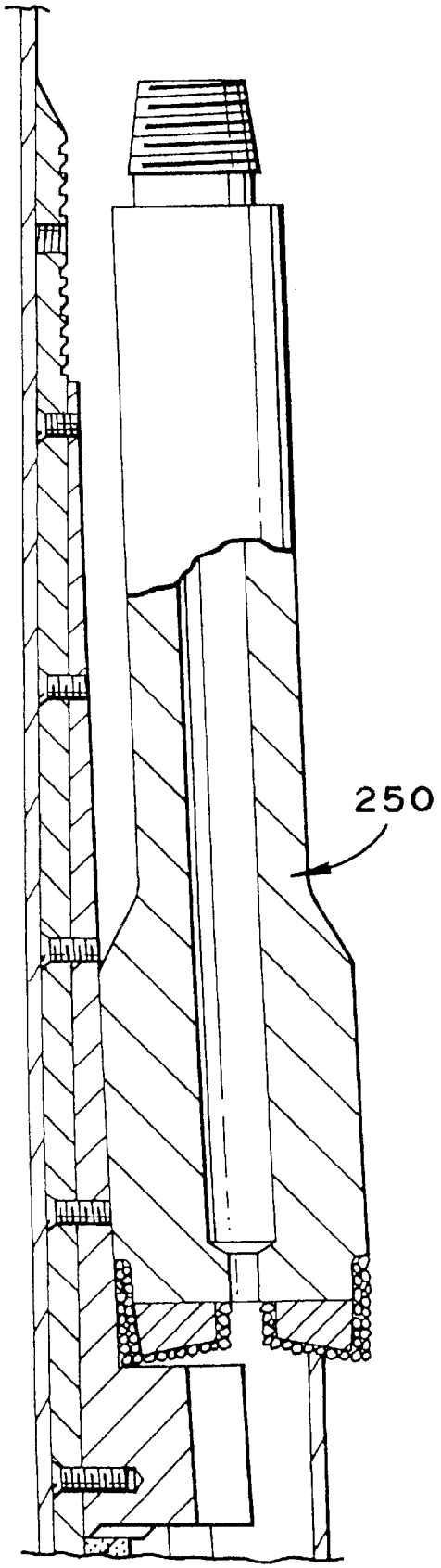

As shown in FIG. 11D the mill 250 has milled completely through the casing G and has extended the bore B down beyond a plug element 240 and a sub 218. Further milling may be conducted with the mill 250 or other mills, or the mill 250 may be withdrawn from the wellbore.

Figure 12A:
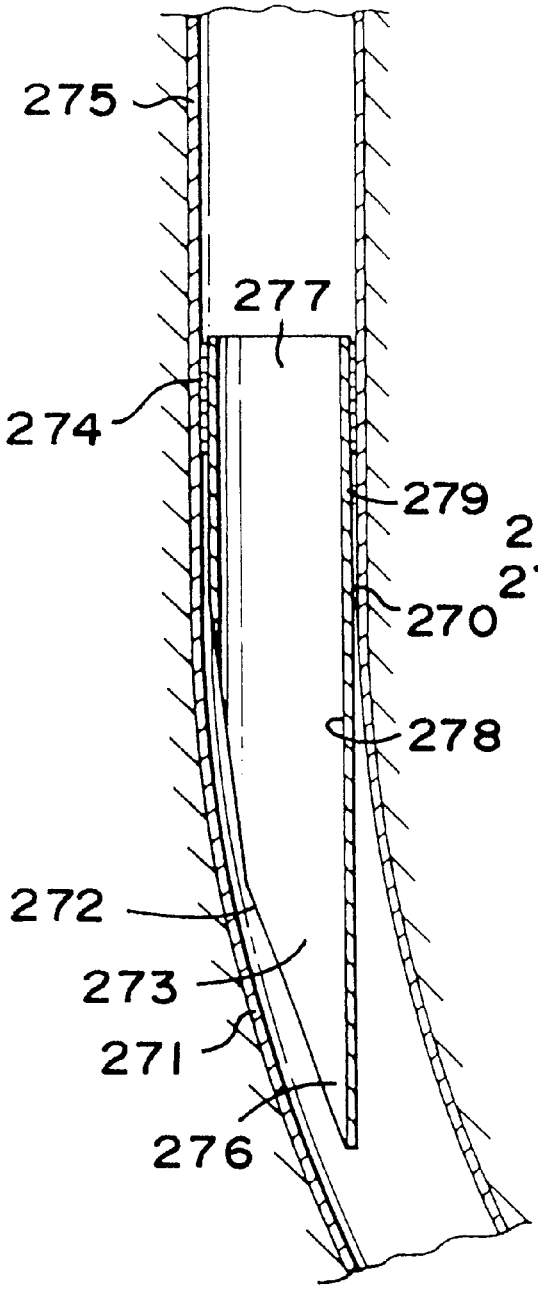
FIG. 12A is a side view in cross-section of a mill guide according to the present invention anchored in a wellbore casing.
Figure 12B:
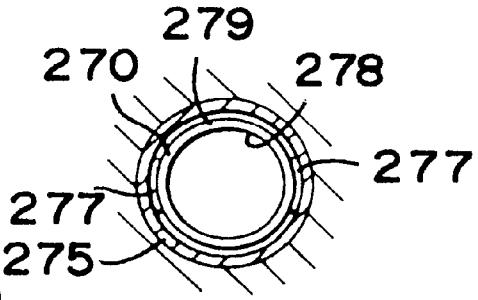
FIG. 12B is a top end cross-sectional view of the mill guide and casing of FIG. 12A.

FIGS. 12A and 12B show a mill guide 270 according to the present invention with a hollow cylindrical body 279 having a bore 278 therethrough, an open top end 277 and an open bottom end 276. The mill guide 270 is disposed in a piece of casing 275 which is part of a string of casing (not shown) in a wellbore in the earth. An anchor 274 (or anchors) holds the mill guide 270 in place at a desired location in the casing with an opening 273 of the mill guide's bottom end 276 disposed and oriented so that a mill passing through the mill guide 270 will mill a desired area of the casing, creating a desired hole, slot, opening, or window. The bottom end 276 of the mill guide 270 is formed or cut to have a desired shape 272. This shape 272 may be made to correspond to a curved portion 271 of the casing 275.

Figure 13:
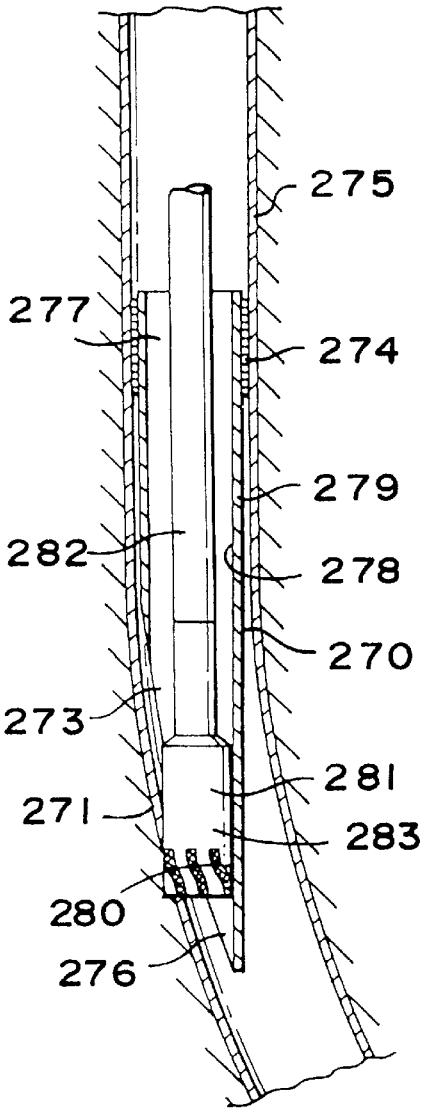
FIG. 13 is a side view of the system of FIG. 12A including a milling apparatus.

As shown in FIG. 13, a mill 281 on a string of drill pipe 282 has been introduced through the casing 275 and the mill guide 270 to contact the casing 275 and begin to mill a hole therethrough. A body 283 of the mill 281 has a length such that at least about a fourth of the desired opening is milled (and in other aspects substantially all of the desired opening) while the mill body 283 remains in contact with a side 280 of the bottom end 276 of the mill guide 270, thus providing a continuous reaction support during part or substantially all of the milling. The side 280 may be the same thickness as a side 298 which is shorter than the side 280; or the side 280 may be thicker than the side 298. The interior of the side 280 may one or more additional layers of material thereon. Such material may also inhibit the mill from milling the side 280. This additional material may be any desired practical thickness and may be any known suitable material, including, but not limited to, steel, carbide steel, stainless steel, known alloys, and hardfacing material. Such a layer or layers may be added by any known method (e.g., welding or hardfacing) or may be formed integrally of the side 280.

Figure 14:
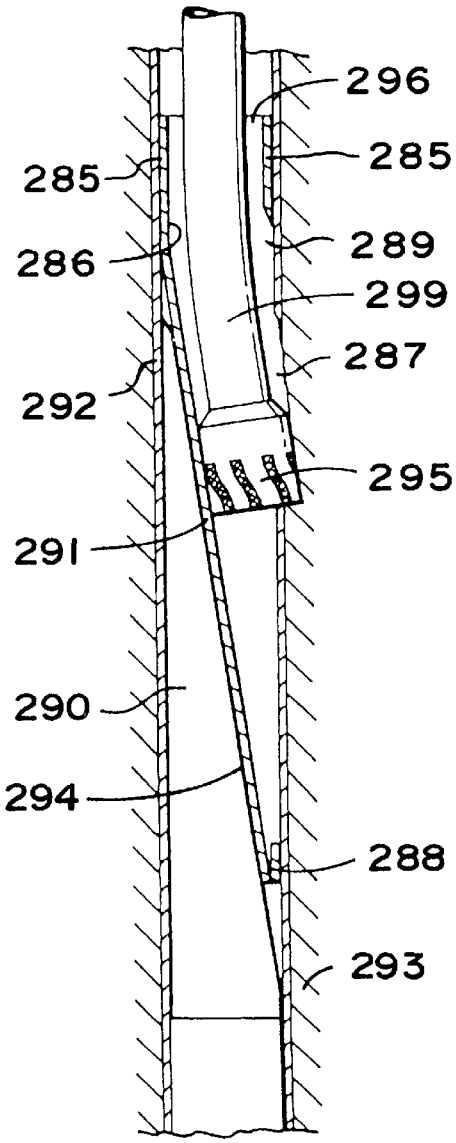
FIG. 14 is a side view, partially in cross-section of a system according to the present invention.

FIG. 14 shows a mill guide 285 with a hollow body 286, a top open end 296, a bottom end point 288, a side opening 289, and a slanted side member 291. A whipstock 290 disposed in a casing 292 in a wellbore 293 has a concave surface 294 which corresponds to the shape of the slanted side member 291. The mill guide 285 is made of a strong metal, e.g. steel, so that the slanted side member 291 protects the concave surface 294 from the effects of a mill 295 on flexible pipe 299. The whipstock 290 and the side opening 289 are positioned so that a window 287 is cut at a desired location on the casing 282. As shown in FIG. 14 the window 287 has only been partially milled and will be completed as the mill 295 moves down the slanted side member 291. It is within the scope of this invention for the mill guide 285 and the whipstock 290 to be connected together; to be formed integrally as one member; or for the mill guide 285 to be releasably connected to the whipstock (e.g. but not limited to, by one or more shear studs or shear lugs). In another aspect the mill guide and the whipstock are installed separately. The mills in FIGS. 13 and 14 may be the mill 250 (FIG. 10).

Figure 15A:
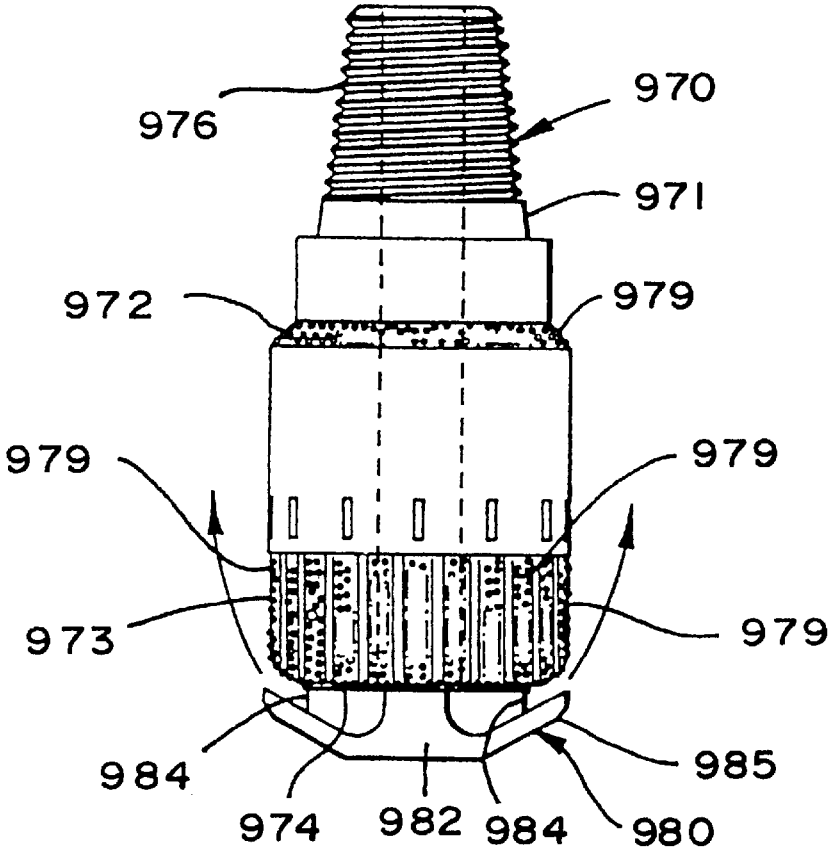
FIG. 15A is a side view of a milling tool according to the present invention with a bottom flow director in cross-section.
Figure 15B:
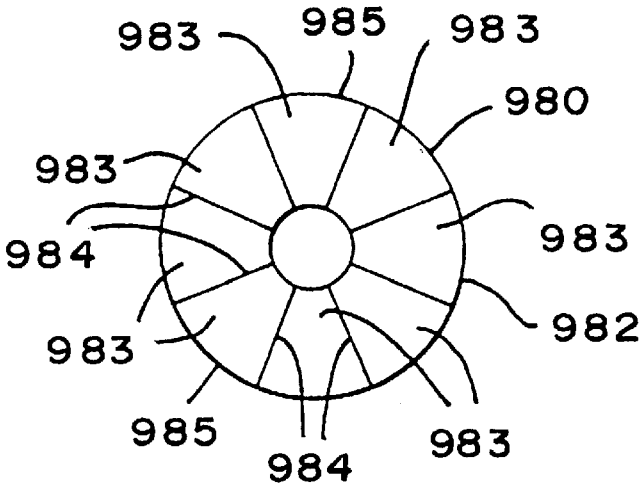
FIG. 15B is a top plan view of the flow director of the tool of FIG. 15A.

FIG. 15A shows a milling tool 970 according to the present invention which has a tool body 971 with a shoulder 972 and lower milling head 973. The tool 970 has fluid flow ports and a central channel. A flow director 980 (FIGS. 15A and 15B) is secured to a bottom end 974 of the tool body 971 (secured e.g. by epoxy, screws, and/or bolts; bolts and screws are preferably disposed off-center with respect to the flow director 980 and off-center and away from the central flow channel through the tool body). As shown in FIG. 15B the flow director has a body 982 and a series of flow directing chambers 983 defined by side walls 984 and an upturned lip or end wall 985. One chamber corresponds to each flow port and exit opening. It is within the scope of this invention to eliminate the side walls 984. An upper threaded end 976 provides for threaded engagement of the tool 970 with other connectors or tools. Arrows indicate fluid flow direction. Milling elements 979 (e.g. but not limited to diamond milling elements which work more effectively when cooled by the flowing fluid) are on the circumferential side surface of the lower milling head 973, on the shoulder 972 and on the bottom end 974. The curved corner shaped of the flow director 980 facilitates co-action of a milling tool with a concave surface of a whipstock's concave member. With a flow director made of aluminum or plastic, such a flow director can be easily worn away by a formation after a side milling operation is completed to expose milling elements on the lower end of the tool body.

Figure 16A:
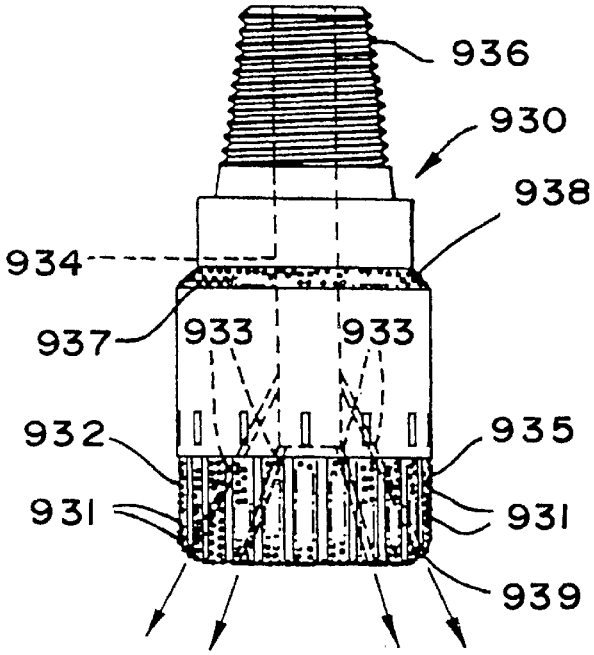
FIG. 16A is a side view of a milling tool according to the present invention.
Figure 16B:
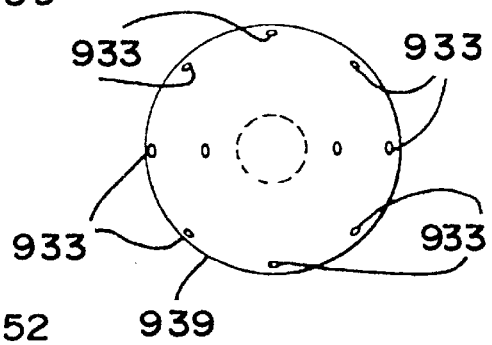
FIG. 16B is a bottom end view of the milling tool of FIG. 16A.
Figure 17:
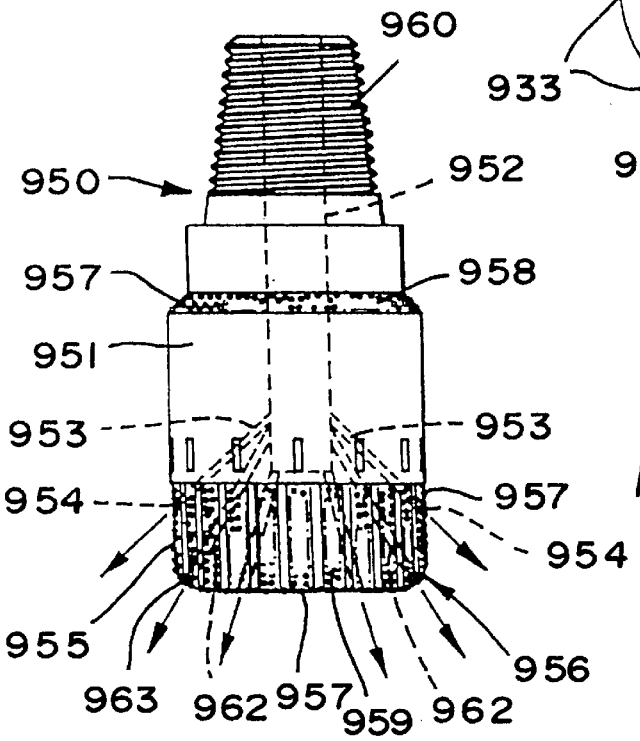
FIG. 17 is a side view of a milling tool according to the present invention.

FIG. 17 shows a mill 950 according to the present invention with a mill body 951 having a central circulating fluid flow channel 952 therethrough which communicates with a plurality (one or more) side fluid flow ports 953 each having an exit opening 954 on a circumferential side surface 955 of a mill head 956. A plurality of milling elements 957 are on the side of the tool and on an upper shoulder 958 and lower end 959. A top end 960 of the mill 950 is threaded. This tool may also have one or more fluid flow ports 962 with an exit opening at a lower corner 963 of the mill head 956 (like those of the tool in FIG. 16A).

FIG. 16A shows a mill 930 with a head 935 with milling elements 931 on a side circumferential surface 932 thereof.

Such elements may also be used on the bottom end of the tool. A plurality of fluid flow ports 933 communicate with a central fluid flow channel 934 through the mill 930 to provide fluid to exit at bottom end corners 939 on the mill 930 to cool the elements 931. The mill 930 has an upper threaded end 936 for interconnection with other wellbore apparatuses. Milling material and/or elements 937 may be provided on an upper shoulder 938 of the mill 930.

Figures 18A, 18B, 18C, 19, 20:
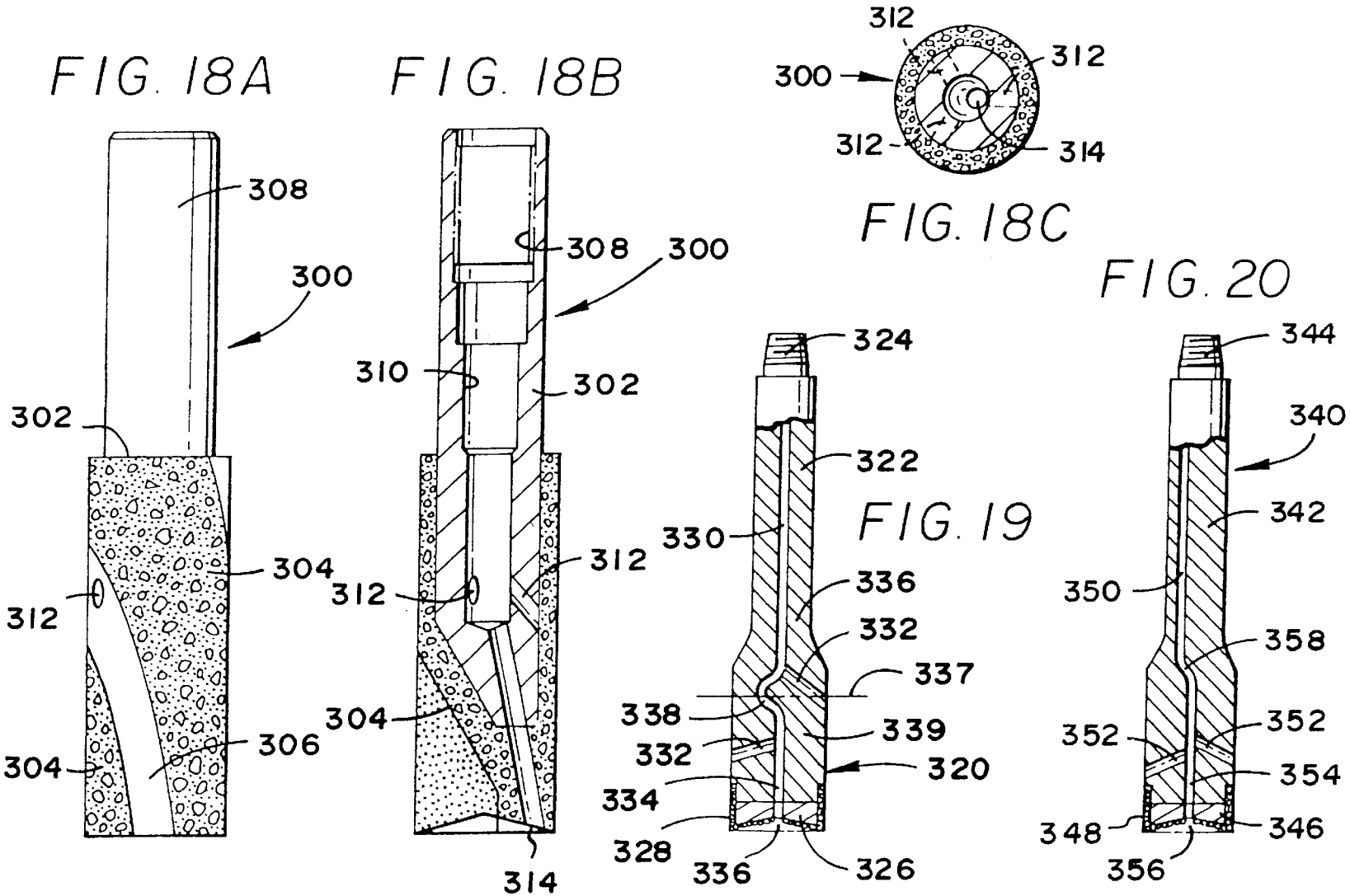
FIG. 18A is a side view of a mill according to the present invention.
FIGS. 18B and 18C are cross-section views of the mill of FIG. 18A.
FIG. 19 is a side view in cross section of a mill according to the present invention.
FIGS. 20–27 are side views in cross section of a mill according to the present invention.

FIGS. 18A–18C show a mill 300 according to the present invention which has a body 302, milling blades or surfaces 304, and fluid courses 306 between the surfaces 304. An upper internally threaded end 308 provides for releasable connection to a workstring of pipe or coiled tubing.

A central bore 310 extends from a top of the body 302 downwardly and is intersected by fluid bores 312 that provide a path for fluid to exit the body to flush milled cuttings and debris up and away from the mill and by a fluid flow bore 314 that extends from a lower end of the central bore 310 down to the lowest end of the body 302. A core that begins to core the mill may enter the bore 314 at some point above the lower end of the mill.

The surfaces 304, the lower end of the body 302, and the interior surface of at least a lower portion of the bore 314 may be dressed with milling material, e.g. but not limited to milling inserts and/or crushed tungsten carbide matrix milling material. By using such material in the bore 314 the separation of a core from a tubular being milled is facilitated. It is also within the scope of this invention to dress the upper end of the bore 314 or the whole bore 314 and/or the lower end of the central bore 310 with such material.

The bore 314 (and the bores in the other embodiments disclosed herein) may have an inner diameter sized in relation to a core that will be produced by milling with the mill 300 (or with the mills in the other embodiments). In one aspect, the bore diameter is slightly larger than the wall thickness of the tubular being milled. In another aspect the bore diameter is significantly larger than the width of a core being produced by milling so the core does not impede washing fluid flow out from the core bore and, in such a case, one or more fluid flow bores like the bores 312 may be optional.

As shown in FIG. 18B, it is preferred that there be a bend at some point in the compound bore 310–314 or that the bore 314 meet the bore 310 at an angle so that a top core end proceeding to the bend or angle (or into the angled portion of a bore like the bore 314 itself) is held and more easily twisted away from a tubular being milled, thus inhibiting or preventing damaging "coring" of the mill by a core that moves unimpeded up into a mill's inner body. Such coring can result in a cessation of milling and/or in the production of a relatively large core that is difficult to manipulate and remove, particularly if it drops from the mill's interior and falls down into the wellbore.

FIG. 19 shows a mill 320 according to the present invention with a body 322 having a threaded top end 324; a lower end 326 dressed with milling material 328; a top flow bore 330 extending from the top of the body 322 downwardly; washing fluid channels 332 in fluid communication with the bore 330 and the space outside the mill 320; a core bore 334 extending up from a lower opening 336; and a twist bore 338 interposed between and in fluid communication with the top flow bore 330 and the core bore 334. As with the bend between the bores 310-314 (FIG. 18B), the twist bore facilitates holding of a top core end and separation of a core from a tubular being milled. As shown the bores have essentially the same inner diameter, but it is within the scope of this invention for all three diameters to be different; for the twist bore to be larger or smaller in inner diameter than the other two bores; for any two of the bores to have a similar inner diameter; and, in one aspect, for the core bore to be slightly larger than the width of a core to be produced and for the twist bore and/or top bore to be larger or smaller in inner diameter than the core bore (all as with all multi-bore mill embodiments disclosed herein); and, depending on the core bore diameter, the washing fluid channels (at least one, two, or three in certain embodiments) are optional for all multi-bore mill embodiments herein. In cross-section the bore 330 is essentially in the center of a cylindrically shaped body 322, as is the bore 334 in a lower cylindrical bottom piece 339.

It is within the scope of this invention to employ any bend angle between two bore portions (e.g. as with the top and core bores of FIG. 18B) and/or to use any bent, twisted, curved, helical, or undulating intermediate bore to receive and hold a core top end to facilitate the core's separation from a tubular being milled. Such an intermediate bore itself may include a plurality of sub-bores at angles to each other.

For ease of manufacture, shipping, and/or assembly any mill disclosed herein may be made of multiple pieces that are threaded together, welded together, or otherwise secured together for use. For example the mill 320 may be made of two pieces, shown schematically as a top piece 336 above a line 337 (FIG. 19) and a bottom piece 339 below the line 337. Appropriate threading, in certain embodiments, is used with extensions for the threads if needed.

FIG. 20 shows a mill 340 according to the present invention with a cylindrical body 342 having a threaded top end 344; a lower end 346 dressed with milling material 348; a top flow bore 350 (off center in the body 342) extending from the top of the body 342 downwardly; washing fluid channels 352 in fluid communication with the bore 350 and the space outside the mill 340; a core bore 354 (essentially centered in the body) extending up from a lower opening 356; and a twist bore 358 interposed at an angle between and in fluid communication with the top flow bore 350 and the core bore 354. As with the bend between the bores 310–314 (FIG. 18B), the twist bore facilitates holding of a top core end and separation of a core from a tubular being milled. In the mill 340, the top bore 350 is offset from a center of the body 342 and the core bore is essentially at the center. These positions may be reversed.

Figure 21:
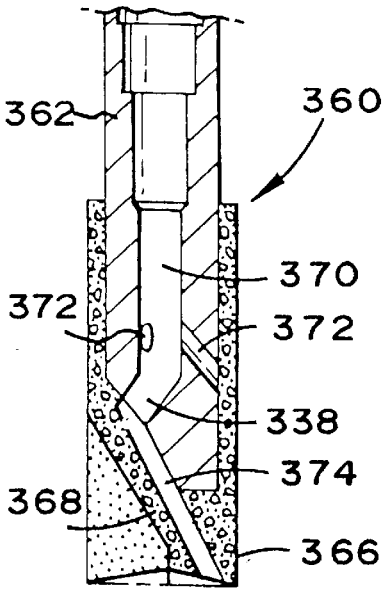

FIG. 21 shows a mill 360 (similar to the mill 300) according to the present invention with a body 362 having a threaded top end (not shown); a lower end 366 dressed with milling material 368; a top flow bore 370 extending from the top of the body 362 downwardly; washing fluid channels 372 in fluid communication with the bore 370 and the space outside the mill 360; a core/fluid bore 374 extending up from a lower opening 376; and a twist bore 338 interposed between and in fluid communication with the top flow bore 370 and the core bore 374. As with the bend between the bores 310–314 (FIG. 18B), the twist bore facilitates holding of a top core end and separation of a core from a tubular being milled. If a core does not move up to the twist bore, the angle of the core/fluid bore 374 alone facilitates core separation.

Figure 22:
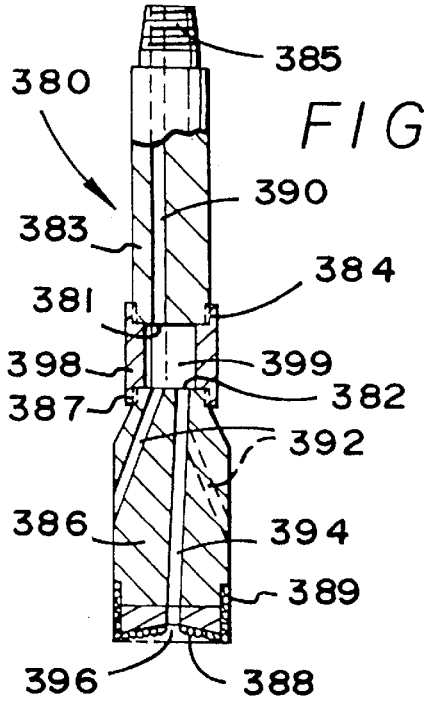

FIG. 22 shows a mill 380 according to the present invention having a cylindrical threaded top part 383 with a bottom threaded end 384 and a top threaded end 385; a lower part 386 with a top threaded end 387 and a bottom end 389 dressed with milling material 388; a top flow bore 390 (off center) in the top part 383 extending downwardly at an angle from center; washing fluid channels 392 in fluid communication with a core bore 394 and the space outside the mill 380; the core bore 394 extending at an angle from a longitudinal axis of the lower part 386 up from a lower opening 396 to a top end of the lower part 386; and a hollow coupling 398 interposed between and in fluid communication with the top flow bore 390 and the core bore 394.

The hollow coupling 398 has a fluid bore 399 therethrough that is in fluid communication with the top flow bore 390 and the core bore 394. The coupling 398 and parts 383 and 386 may be marked exteriorly so that upon connection a top opening 382 of the core bore is misaligned with a bottom opening 381 of the top flow bore 390 so that entry is inhibited or prevented of a top end of a core passing up through the coupling 398 into the bottom opening 381. A coupling such as the coupling 398 (with either exterior or interior threads, or one type on one end and the other type on the other end) may be used with any mill disclosed herein and any such mill may be made up with a top part and bottom part as is the mill 380. A line (as the line 337, FIG. 19) separating two such mill pieces can be positioned through a twist or bent bore or either above such a bore or below it for any embodiment herein.

Figure 23:
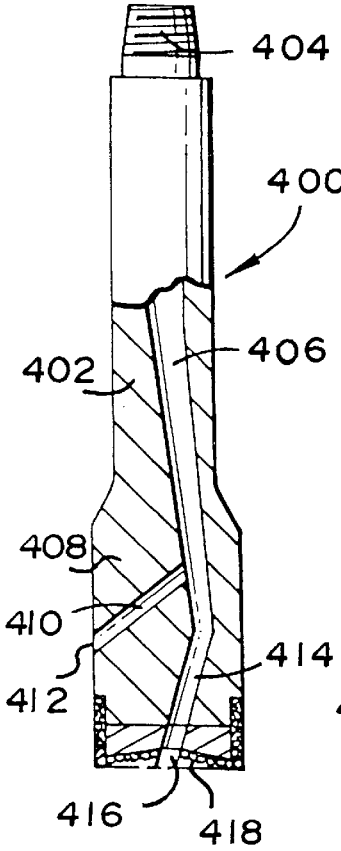

FIG. 23 shows a mill 400 with a cylindrical mill body 402 and a top threaded end 404. A flushing fluid flow channel 406 extends from the top of the body down into a broader cylindrical part 408 of the body where it branches into a side fluid flow channel 410 having a side exit 412 and a core channel 414 that extends down to a bottom center opening 416. The core channel 414 is disposed and sized for receiving a core of material formed when the mill 400 mills an opening in a tubular in a wellbore in the earth. Preferably the core channel 414 is offset with respect to the flushing fluid flow channel and, in one aspect, the core channel 414 is at an angle to a longitudinal axis of the mill body 402. Martix milling material 418 and/or milling inserts (e.g. of tungsten carbide) is applied to an interior surface at the lower end of the core channel 414 to facilitate separation of a core entering into the core channel from a tubular being milled.

Figure 24:
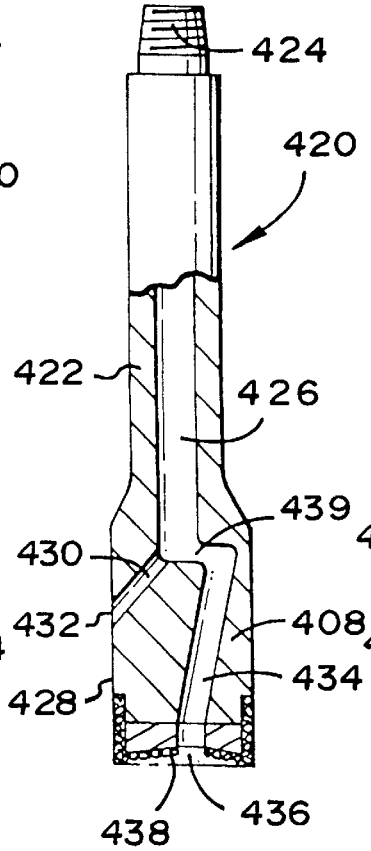

FIG. 24 shows a mill 420 with a cylindrical mill body 422 and a top threaded end 424. A flushing fluid flow channel 426 extends from the top of the body down into a broader part 428 of the body where it branches into a side fluid flow channel 430 having a side exit 432 and a core channel 434 that extends down to a bottom center opening 436. The core channel 434 is disposed and sized for receiving a core of material formed when the mill 420 mills an opening in a tubular in a wellbore in the earth. Preferably the core channel 434 is offset with respect to the flushing fluid flow channel and, in one aspect, the core channel 434 is at an angle to a longitudinal axis of the mill body 422. A short horizontal intermediate flow channel 439 interconnects the flushing fluid flow channel 426 and the core channel 434. Martix milling material 438 and/or milling inserts (e.g. of tungsten carbide) is applied to an interior surface at the lower end of the core channel 434 to facilitate separation of a core entering into the core channel from a tubular being milled. As with other embodiments, such milling material may be used on all or any part of the bore to facilitate core separation and/or milling of a core.

Figure 25:
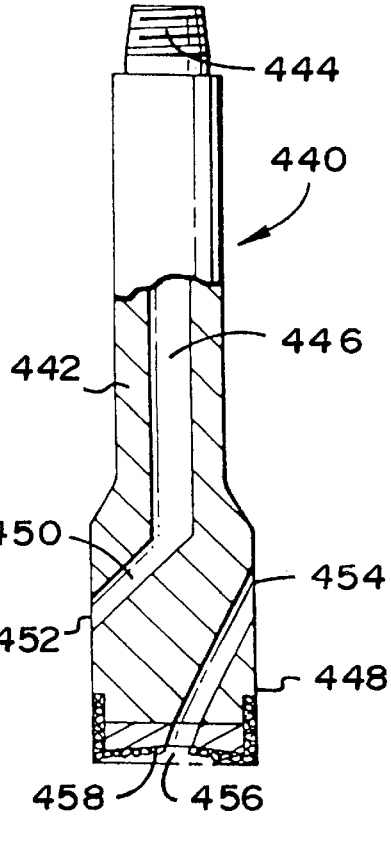

FIG. 25 shows a mill 440 with a cylindrical mill body 442 and a top threaded end 444. A flushing fluid flow channel 446 extends from the top of the body down into a broader part 448 of the body where it continues into a side fluid flow channel 450 having a side exit 452 and a core channel 454 that extends down to a bottom center opening 456. The core channel 454 is disposed and sized for receiving a core of material formed when the mill 440 mills an opening in a tubular in a wellbore in the earth. Preferably the core channel 454 is offset with respect to the flushing fluid flow channel and, in one aspect, the core channel 454 is at an angle to a longitudinal axis of the mill body 442. The side exit fluid flow channel 452 may exit at any desired point on the side of the mill body or at an opening on the mill body bottom (as may any flushing channel in any of the mills in FIGS. 18A–27). Martix milling material 458 and/or milling inserts (e.g. of tungsten carbide) is applied to an interior surface at the lower end of the core channel 454 to facilitate separation of a core entering into the core channel from a tubular being milled.

Figure 26:
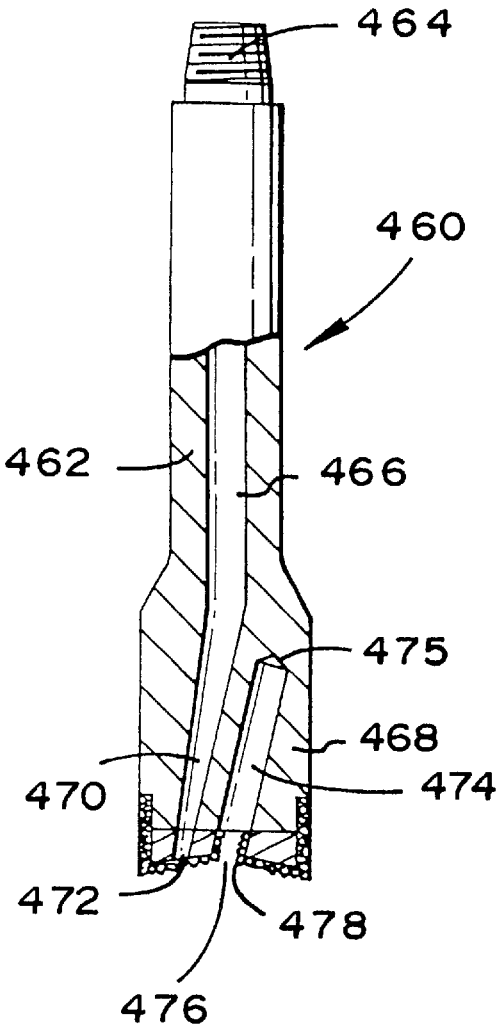

FIG. 26 shows a mill 460 with a cylindrical mill body 462 and a top threaded end 464. A flushing fluid flow channel 466 extends from the top of the body down into a broader part 468 of the body where it continues into a lower fluid flow channel 470 having a bottom exit 472. A core channel 474 extends up from the bottom of the body 462 from an opening 476. The core channel 474 is disposed and sized for receiving a core of material formed when the mill 460 mills an opening in a tubular in a wellbore in the earth. Preferably the core channel 474 is offset with respect to the flushing fluid flow channel and, in one aspect, the core channel 474 is at an angle to a longitudinal axis of the mill body 462. The core channel 474 ends at a top end thereof 475 which a core will abut and beyond which a core will not move. Martix milling material 478 and/or milling inserts (e.g. of tungsten carbide) is applied to an interior surface at the lower end of the core channel 474 to facilitate separation of a core entering into the core channel from a tubular being milled.

Figure 27:
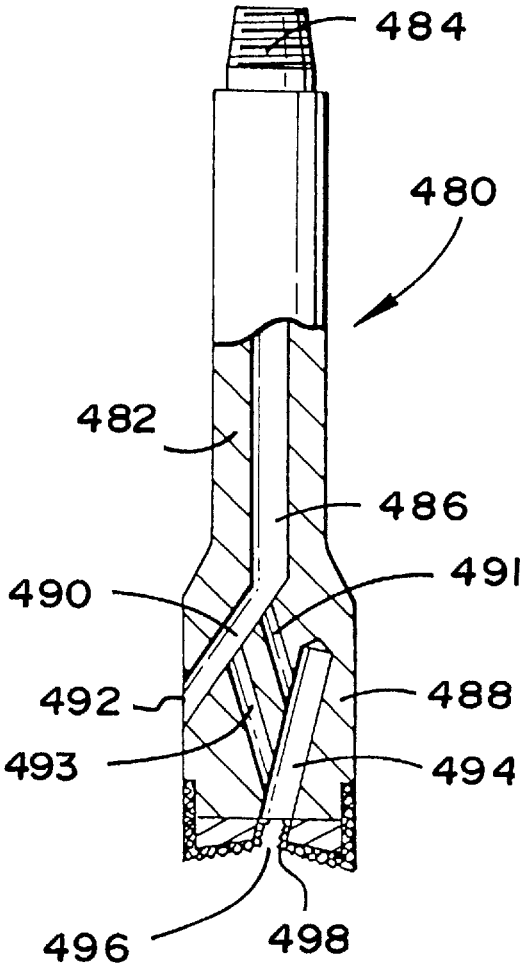

FIG. 27 shows a mill 480 with a mill body 402 and a top threaded end 484. A flushing fluid flow channel 486 extends from the top of the body down into a broader part 488 of the body where it branches into a side fluid flow channel 490 having a side exit 492 and intermediate flow channels 491 and 493 that intercommunicate with a core channel 494 that extends down to a bottom center opening 496. The core channel 494 is disposed and sized for receiving a core of material formed when the mill 400 mills an opening in a tubular in a wellbore in the earth. Preferably the core channel 494 is offset with respect to the flushing fluid flow channel and, in one aspect, the core channel 494 is at an angle to a longitudinal axis of the mill body 482. Martix milling material 498 and/or milling inserts (e.g. of tungsten carbide) is applied to an interior surface at the lower end of the core channel 494 to facilitate separation of a core entering into the core channel from a tubular being milled. In one aspect the channels 491 and 493 are sized so that a core will not enter them. As with the mill of FIG. 19, any mill described herein may be made of two or more interconnectible pieces. In one aspect such a multipiece design facilitates creation of the various interior channels.

Figure 28:
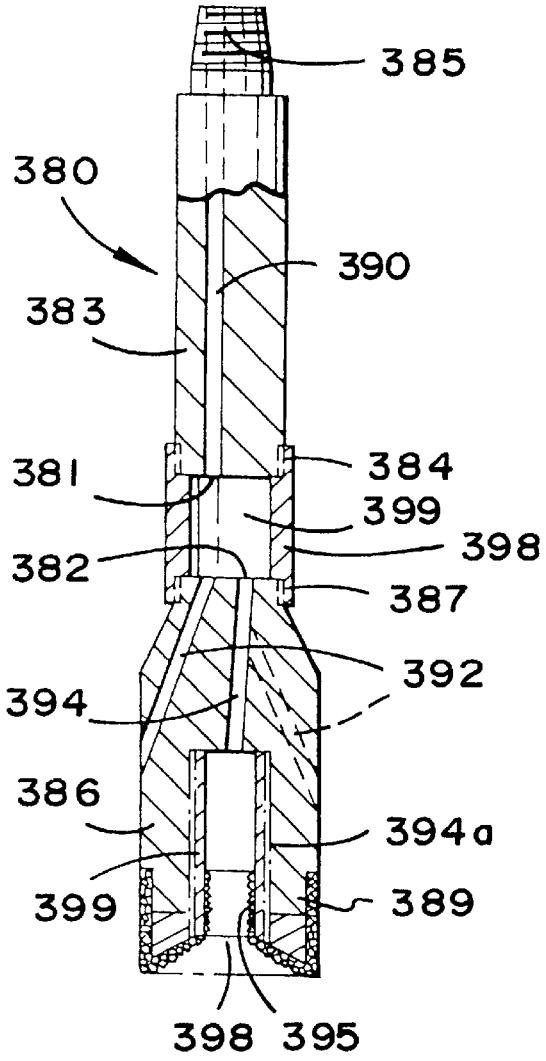
FIG. 28 is a side view in cross section of a mill according to the present invention.
Figure 29A:
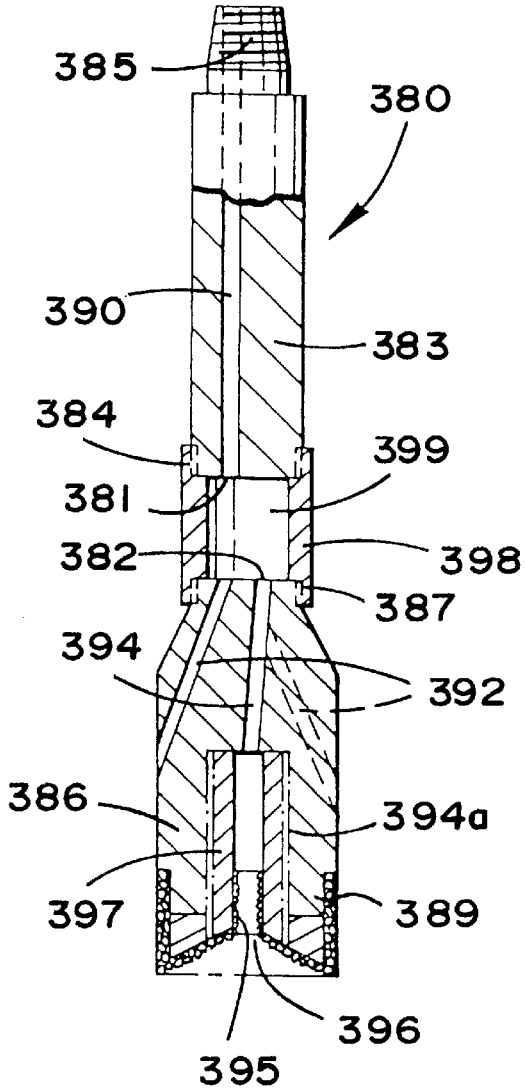
FIG. 29A is a side view in cross section of a mill according to the present invention.
Figure 29B:
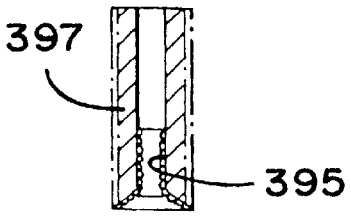
FIG. 29B is a side view in cross section of a core bore insert according to the present invention which is shown in the mill in FIG. 29A.
Figure 29C:
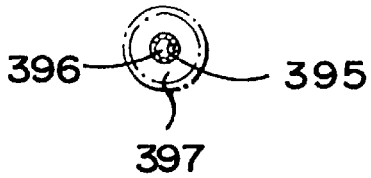
FIG. 29C is a top view of the core bore insert of FIG. 29B.

FIGS. 28 and 29A show variations of the mill 380 of FIG. 22.

FIG. 28 shows a mill 380 with an interiorly threaded channel 394*a* open at its bottom to the space below the mill 380. A core bore insert 399 with an exteriorly threaded body is removably secured in the channel 394*a*. The core bore insert has a core channel 398 sized in diameter and/or in length for receiving a core of anticipated size from a tubular of known wall thickness and for facilitating separation of said core from said tubular. The core channel 398 extends from a top end of the core bore insert 399 to a bottom end thereof. The channels 398 and 394 are in fluid communication and fluid is initially flowable out from the bottom end of the channel 398. The threading on the insert is preferably configured so that mill rotation does not back out the insert. In addition to or instead of threaded mating, a core bore insert according to this invention may be welded in place and/or held in place with pins or bolts through the mill body and insert body.

The mill 380 in FIG. 29A has a core bore insert 397, like the core bore insert 399, but with a smaller diameter core channel 396. The outer diameter of both core bore inserts 399 and 397 is the same so that either core bore insert is usable in a single mill. It is within the scope of this invention to provide multiple (two, three, four or more) core bore inserts, each having a different diameter and/or a different length to handle anticipated cores of different diameter and/or different length. Such a core bore insert or set of two or more different core inserts may be used with any known mill and with any mill described herein which has a suitable channel or recess for receiving the core bore insert(s).

Matrix milling material and/or inserts 395 (collectively "milling material") may be used in the core bore insert's channel as described above for core bores in other embodiments, on all or part of the channel.

In any core bore insert disclosed herein, the core bore channel may be angled from a longitudinal axis of the core bore insert and/or angled from a longitudinal axis of a mill body of a mill in which the core bore insert is removably or permanently emplaced. Alternatively (or additionally) any channel in a mill into which a core bore insert is emplaced may be at an angle to a longitudinal axis of the mill or in line with said axis. The core bore insert may itself contain a multi-component channel with one part at an angle to another part. Also, the core channel may extend for the full length of the core bore insert and be in fluid communication with another fluid flow channel in a mill, or the core channel of the core bore insert may (like the core channel 474, e.g.) simply terminate at some point within the core bore insert.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A wellbore mill comprising a body having a top and a bottom and a first fluid flow channel extending longitudinally through said body from top to bottom, the first fluid flow channel having an upper end and a lower end, milling apparatus on the body, the lower end of the first fluid flow channel having an opening sized for receiving a core of material from a tubular member milled by the mill, and at least a portion of the first fluid flow channel offset from the remainder of the first fluid flow channel to facilitate separation of the core from the tubular member.

2. The mill of claim 1 further comprising at least one side fluid flow channel having an inner end in fluid communication with the first fluid flow channel and an outer end in fluid communication with a space outside the mill so that fluid pumped down the first fluid flow channel flows out into the space.

3. The mill of claim 1 wherein the first fluid flow channel comprises an upper portion and a lower portion, the upper portion extending through the body of the mill and the lower portion extending through the body of the mill at an angle to the upper portion so that separation of a core with a core upper end passing through the lower portion and into the upper portion is facilitated by receipt of said core upper end in the upper portion of the first fluid flow channel.

4. The mill of claim 3 further comprising the mill body including a top body and a bottom body connected to the top body, the top body including the upper portion of the first fluid flow channel and the bottom body including the lower portion of the first fluid flow channel.

5. The mill of claim 4 further comprising a coupling interposed between and connecting together the top body and the bottom body, the coupling having a coupling fluid flow bore therethrough in fluid communication with the upper portion of the first fluid flow channel of the top body and with the lower portion of the first fluid flow channel of the bottom body.

6. The mill of claim 5 wherein the coupling fluid flow bore has an inner diameter larger than an inner diameter of the upper portion of the first fluid flow bore and larger than an inner diameter of the lower portion of the first fluid flow bore.

7. The mill of claim 5 wherein the upper portion of the first fluid flow bore is offset from the lower portion of the first fluid flow bore, the coupling disposed so that entry of a core top end into the upper portion of the first fluid flow bore is inhibited, the core top end passing from the lower portion of the first fluid flow bore into the coupling fluid flow channel.

8. The mill of claim 1 wherein the lower portion of the first fluid flow channel has a lower opening at a bottom of the body.

9. The mill of claim 8 wherein the lower opening is located substantially at a center of a lower portion of the body.

10. The mill of claim 9 wherein the lower portion of the first fluid flow channel is located substantially at a center of the body, the upper portion thereof is offset from said center, and the first fluid flow channel has an intermediate portion interconnecting the upper and lower portions and at an angle to each of said upper and lower portions.

11. The mill of claim 9 wherein a first portion of the first fluid flow channel is located substantially at a center of the body, a second portion thereof is offset from said center, and the first fluid flow channel has an intermediate portion interconnecting the first and second portions and at an angle to each of said first and second portions.

12. The mill of claim 8 wherein the body has a center at its lowest portion and the lower opening is offset from said center.

13. The mill of claim 1 wherein the body has a lower end with a lower surface thereacross, said lower surface inclined upwardly from an outer edge of the lower end up to a central point of the lower end to facilitate movement of the mill outwardly from a tubular member being milled in a wellbore.

14. The mill of claim 1 wherein the body has a lower end having an outer lower surface around a circumference of the body, said outer lower surface tapering inwardly from a level above a lowest boundary of the lower end to said lowest boundary.

15. The mill of claim 1 wherein the body has a lower end with an extended outer circumferential surface positionable substantially parallel to and for co-acting with an inner surface of a mill guide in a wellbore.

16. The mill of claim 1 further comprising a mill guide in contact with the body of the wellbore mill, said mill guide comprising a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide.

17. A wellbore milling method for milling an opening in a selected tubular of a tubular string in a wellbore, the method comprising installing a mill on a working string into the wellbore at a selected desired point for milling the opening in the tubular, the mill comprising a body with milling apparatus thereon and having a top and a bottom and a first fluid flow channel extending longitudinally through said body from top to bottom, the first fluid flow channel having an upper end and a lower end, the lower end of the first fluid flow channel having an opening sized for receiving a core of material from a tubular member milled by the mill, and at least a portion of the first fluid flow channel offset from the remainder of the first fluid flow channel to facilitate separation of the core from the tubular member, and rotating the mill to mill an opening in the selected tubular.

18. The wellbore milling method of claim 17 comprising creating a core of material of the selected tubular member by milling down the selected tubular, said core received through said opening into at least the lower end of the first fluid flow channel, and separating with said mill said core from said selected tubular member.

19. The wellbore milling method of claim 17 further comprising positioning a mill guide in said tubular string in said wellbore, said mill guide comprising a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide, and urging said mill toward said selected tubular with said mill guide.

20. The wellbore milling method of claim 17 wherein there is at least one side fluid flow channel having an inner end in fluid communication with the first fluid flow channel and an outer end in fluid communication with a space outside the mill so that fluid pumped down the first fluid flow channel flows out into the space and the method further comprising pumping fluid out from the outer end of the side fluid flow channel to move milled material up away from the mill.

21. The wellbore milling method of claim 17 further comprising positioning a whipstock in said tubular string in said wellbore, and contacting said whipstock with said mill to divert said mill toward said selected tubular.

22. The milling method of claim 17 further comprising rotating said mill with a downhole motor disposed in said working string.

23. The milling method of claim 17 wherein the working string is a string consisting of tubulars from the group consisting of pipe and coiled tubing.

24. A wellbore mill comprising a mill body with milling apparatus thereon and a top and a bottom and a side exterior surface, at least one flushing fluid flow channel extending down from the top of the body to an exit opening on the side exterior surface, fluid pumpable from above the wellbore mill down into the flushing fluid flow channel and out from the exit opening to move material milled by the wellbore mill up away from the wellbore well, and a core channel extending from a bottom center opening at a bottom of the mill body and up into the mill body for receiving a core of material from a tubular milled by the wellbore mill, the core channel at an angle to a longitudinal axis of the mill body.

25. The wellbore mill of claim 24 further comprising the core channel having a top end within the mill body beyond which the core does not move.

26. The wellbore mill of claim 24 further comprising the core channel having a core channel opening on the side exterior surface through which a portion of the core may move.

27. The wellbore mill of claim 24 further comprising at least one intermediate fluid flow channel within fluid communication with the at least one flushing fluid flow channel and the core channel for providing flushing fluid into the core channel.

28. The wellbore mill of claim 27 wherein the at least one intermediate fluid flow channel is at an angle of at least 90° to the core channel.

29. The wellbore mill of claim 27 further comprising a mill guide in contact with the body of the wellbore mill, said mill guide comprising a hollow body with an upper end and an upper end opening and a lower end with a lower end opening, the lower end opening having a slanted portion to permit the mill to contact an interior portion of the tubular in the wellbore at the desired milling location while the mill also contacts a portion of the lower end of the mill guide.

30. A wellbore mill comprising a body having a top and a bottom, milling apparatus on the body, and a core bore insert channel extending up from the bottom of the body for receiving and holding a core bore insert.

31. The wellbore mill of claim 30 further comprising a first core bore insert within the core bore channel, the first core bore insert having a first core channel therethrough with a first diameter for receiving a core milled from a wellbore tubular.

32. The wellbore mill of claim 31 wherein the core bore insert is removably held in the core bore channel.

33. The wellbore mill of claim 31 further comprising at least one second core bore insert emplaceable in the core bore insert channel of the wellbore mill body, the at least one second core bore insert having an inner diameter different from the first diameter of the first core bore insert.

34. The wellbore mill of claim 31 wherein an amount of milling material is on at least a portion of the first core channel to facilitate separation of a core from a tubular.

35. A first core bore insert for insertion within a core bore insert channel in a body of a wellbore mill, the core bore insert comprising a body separate from the core bore insert channel of the wellbore mill with a top and a bottom, a first core channel extending from the bottom of the body toward the top and having a first core channel inner diameter, and the first core channel sized to receive a core milled from a wellbore tubular by the wellbore mill.

36. The first core bore insert of claim 35 further comprising milling material on at least a portion of the core channel to facilitate separation of a core from a tubular.

37. The first core bore insert of claim 35 further comprising at least one additional core bore insert, said at least one additional core bore insert having an inner diameter different than the first core channel inner diameter.

38. The first core bore insert of claim 35 further comprising at least one additional core bore insert, said at least one additional core bore insert having a length different than the first length wherein the first core channel has a first length from one end thereof to the other.

39. The core bore insert of claim 35 wherein the core bore channel extends all the way through the body from top to bottom.

* * * * *